US005225111A

United States Patent [19]

Imai

[11] Patent Number: 5,225,111

[45] Date of Patent: Jul. 6, 1993

[54] VOLTAGE NON-LINEAR RESISTOR AND METHOD OF PRODUCING THE SAME

[75] Inventor: Osamu Imai, Kasugai, Japan

[73] Assignee: NGK Insulators, Ltd., Japan

[21] Appl. No.: 750,267

[22] Filed: Aug. 27, 1991

[30] Foreign Application Priority Data

Aug. 29, 1990 [JP] Japan ..... 2-225304
Sep. 7, 1990 [JP] Japan ..... 2-235808

[51] Int. Cl.[5] ..... H01C 7/10; H01C 7/13; H01B 1/06

[52] U.S. Cl. ..... 252/519; 252/518; 252/500; 501/126; 338/20; 338/21

[58] Field of Search ..... 338/20, 21; 252/518, 252/519, 500; 501/126

[56] References Cited

U.S. PATENT DOCUMENTS 4,285,839 8/1981 Wong ..... 338/21
4,535,314 8/1985 Kanai et al. ..... 338/21
4,551,268 11/1985 Eda et al. ..... 338/21

FOREIGN PATENT DOCUMENTS 0029749 6/1981 European Pat. Off. .
0241150 10/1987 European Pat. Off. .
56-101712 8/1981 Japan .
62-165304 7/1987 Japan .

*Primary Examiner*—Mark L. Bell
*Assistant Examiner*—C. M. Bonner
*Attorney, Agent, or Firm*—Parkhurst, Wendel & Rossi

[57] ABSTRACT

An improved voltage non-linear resistor having a superior voltage-current characteristic property, a superior switching current impulse withstand capability, a superior lightning current impulse withstand capability, and a large discharge voltage $V_{0.1mA}$ of 230–330 V/mm, a small deterioration rate of the discharge voltage $V_{0.1mA}$ after applying a lightning current impulse, a prolonged electric life under electrical stress and an improved discharged voltage at a large current area is provided which contains zinc oxide as a main component, and desired amounts of subsidiary components of bismuth oxide, cobalt oxide, manganese oxide, antimony oxide, chromium oxide, silicon oxide, nickel oxide, aluminum oxide, boron oxide and silver oxide. The resistor has a discharge voltage of $V_{0.1mA}$ of 230–330 V/mm at a current density of 0.1 mA/cm$^2$ calculated per unit thickness of the sintered resistor, a discharge voltage ration $V_{10A}/V_{0.1mA}$ of 1.2–1.45 a current densities of 10 A/cm$^2$ and 0.1 mA/cm$^2$, a deterioration rate of discharge voltage of not more than 10% at a current density of 0.1 mA/cm$^2$ before and after twice applying a lightning current impulse of a current density of 5 KA/cm$^2$ (4/10 μs wave form), and discharge voltage ratio $V_{0.1mA}/V_{1\mu A}$ of not more than 1.4 at current densities of 0.1 mA/cm$^2$ and 1 μA/cm$^2$.

4 Claims, 2 Drawing Sheets

VOLTAGE NON-LINEAR RESISTOR AND METHOD OF PRODUCING THE SAME

BACKGROUND OF THE INVENTION

1. Field of the Invention

The present invention relates to a voltage non-linear resistor containing zinc oxide as a main component and a method of producing the same. Such resistor may be referred to hereinafter, alternatively, as an "element".

2. Related Art Statement

Heretofore, voltage non-linear resistors containing zinc oxide ZnO as a main component and a small amount of metal oxides, such as $BiO_2O_3$, $Sb_2O_3$, $SiO_2$, $Co_2O_3$, and $MnO_2$, etc., as subsidiary components, have been widely known to have superior non-linear voltage-current characteristic properties, and used in lightning arrestors, etc.

Meanwhile, more than half of electric troubles on overhead transmission or distribution lines arranged on towers at high positions from the ground are from lightning. If an electric potential of the tower is increased due to a lightning strike on a transmission or distribution line thereof, the increased electric potential is discharged from the tower via an arc horn, and subsequent trouble current (follow current) is shut off by a circuit breaker in a transformer station, so that electric transmission through the transmission or distribution line is stopped.

In order to solve the problem, gapless lightning arrestors have hitherto been used having a good response and a superior follow current cut-off property. Such a gapless arrestor has to be newly inserted between the transmission towers, so that a compact lightning arrestor is required as compared with lightning arrestors used in transformer stations.

These lightning arrestors are gapless, so that the voltage non-linear resistors are always applied by an electric current, so that a prolonged superior life under electrical stress of the voltage non-linear resistor is needed from a viewpoint of reliability.

SUMMARY OF THE INVENTION

An object of the present invention is to provide a voltage non-linear resistor which can miniaturize mainly gapless lightning arrestors for a transmission or distribution line use, particularly which can extensively shorten the length in the longitudinal direction of the lightning arrestors.

In the first aspect of a voltage non-linear resistor is provided containing zinc oxide as a main component, and subsidiary components of (a) 0.5–1.2 mole % of bismuth oxide calculated as $BiO_2O_3$,
(b) 0.3–1.5 mole % of cobalt oxide calculated as $Co_2O_3$,
(c) 0.2–0.8 mole % of manganese oxide calculated as $MnO_2$,
(d) 0.5–1.5 mole % of antimony oxide calculated as $Sb_2O_3$,
(e) 0.1–1.5 mole % of chromium oxide calculated as $Cr_2O_3$,
(f) 0.6–2.0 mole % of silicon oxide calculated as $SiO_2$,
(g) 0.8–2.5 mole % of nickel oxide calculated as NiO,
(h) not more than 0.02 mole % of aluminum oxide calculated as $Al_2O_3$,
(i) 0.0001–0.05 mole % of boron oxide calculated as $B_2O_3$, and (j) 0.001–0.05 mole % of silver oxide calculated as $Ag_2O$, and the resistor having
(k) a discharge voltage $V_{0.1mA}$ of 230–330 V/mm at a current density of 0.1 mA/cm$^2$ calculated per unit thickness of the sintered resistor,
(l) a discharge voltage ratio $V_{10A}/V_{0.1mA}$ of 1.2–1.45 at current densities of 10 A/cm$^2$ and 0.1 mA/cm$^2$,
(m) a deterioration rate of discharge voltage of not more than 10% at a current density of 0.1 mA/cm$^2$ before and after applying twice a lightning current impulse of a current density of 5 kA/cm$^2$ (4/10 μs wave form), and
(n) a discharge voltage ratio $V_{0.1mA}V_{1\mu A}$ of not more than 1.4 at current densities of 0.1 mA/cm$^2$ and 1 μA/cm$^2$.

In the second aspect of the present invention, the present invention is a method of producing a voltage non-linear resistor, comprising, i) forming a green body of the voltage non-linear resistor body containing zinc oxide as a main component, and subsidiary components of (a) 0.5–1.2 mole % of bismuth oxide calculated as $BiO_2O_3$,
(b) 0.3–1.5 mole % of cobalt oxide calculated as $Co_2O_3$,
(c) 0.2–0.8 mole % of manganese oxide calculated as $MnO_2$,
(d) 0.5–1.5 mole % of antimony oxide calculated as $Sb_2O_3$,
(e) 0.1–1.5 mole % of chromium oxide calculated as $Cr_2O_3$,
(f) 0.6–2.0 mole % of silicon oxide calculated as $SiO_2$,
(g) 0.8–2.5 mole % of nickel oxide calculated as NiO,
(h) not more than 0.02 mole % of aluminum oxide calculated as $Al_2O_3$,
(i) 0.0001–0.05 mole % of boron oxide calculated as $B_2O_3$, and
(j) 0.001–0.05 mole % of silver oxide calculated as $Ag_2O$, ii) the green body being formed by mixing the main component zinc oxide with a solution containing aluminum corresponding to the amount of (h) aluminum oxide, spray drying the mixture, calcining the spray dried mixture, mixing the calcined mixture with the other metal oxides (a)–(g) and (i)–(j) granulating and forming the mixture, iii) sintering the green body at 1,130°–1,240° C, and iv) heat treating the sintered body at 400°–530° C.

For realizing the aimed miniaturization of the gapless lightning arrestor, namely, decreasing the length and diameter of the lightning arrestor, characteristic properties of the element which is to be accommodated in the lightning arrestor have to be improved, so as to decrease or shorten the total length of the stacked elements and the diameter of the elements.

In order to decrease or shorten the diameter of the element, the switching current impulse withstanding capability of the element has to be improved, because in gapped lightning arrestors and gapless lightning arrestors, switching current impulse energy generated from the switching of a breaker in a transformer station is generally large, and usually determines the diameter of the element.

The inventors have discovered that by using the aforementioned element composition and the production method, the switching current impulse withstanding capability of the element can be improved by raising the discharge voltage ratio $V_{10A}/cm_2/V_{0.1mA}/cm_2$ (to be referred to as "$V_{10A}/V_{0.1mA}$", hereinafter) at current densities of 10 A/cm$^2$ and 0.1 mA/cm$^2$ to 1.25–1.45. Although the diameter of the element can be decreased when the switching current impulse withstanding capability is largely improved, the diameter of the element may sometimes be determined by the lightning current impulse withstanding capability if it is excessively decreased. Thus, preferably, the lightning current impulse withstanding capability should also be improved. Especially, a follow current accompanying an application of a lightning current impulse is flowed in a gapped lightning arrestor, so that the lightning current impulse withstanding capability of the element should preferably be improved in gapped lightning arrestors.

Next, in order to decrease or shorten the length of the lightning arrestors, deterioration of varistor voltage after applying a lightning current impulse has to be suppressed, while improving varistor voltage of the elements accommodated in the lightning arrestor. Varistor voltage used herein means a discharge voltage $V_{0.1mA}$ at a current density of 0.1 mA/cm$^2$.

The inventors have discovered that by using the above-mentioned element composition and production method, an element having a high varistor voltage $V_{01mA}$ of 230–330 V/mm and a deterioration rate of varistor voltage of not more than 10% before and after applying twice a lightning current impulse of a current density of 5 kA/cm$^2$ (4/10 μs waveform) can be obtained. The above test condition for applying the lightning current impulse is based on the condition generally designed for testing the lightning arrestors.

A gapless lightning arrestor is usually designed with a maximum current density of 0.1 mA/cm$^2$ of the element flowing through the arrestor or element accommodated in the arrestor when applied with a rated voltage. If a deterioration rate of the varistor voltage of the element after applying a lightning current impulse is large, large number of the elements has to be used. Thus, the above-described deterioration rate of the varistor voltage is desirably small so as to decrease number of the elements accommodated in the arrestor or shorten the total length of the elements accommodated in the lightning arrestor.

Improvement of the life of the arrestors under electrical stress is very important in practice. The inventors have discussed that an excellent element having a discharge voltage ratio $V_{0.1mA}/cm2/V_{1\mu A}/cm2$ (to be referred as "$V_{0.1mA}/V_{1\mu A}$38 , hereinafter) of not more than 1.4 at current densities of 0.1 mA/cm$^2$ and 1 μA/cm$^2$ and having improved life under electrical stress can be obtained by using the above-mentioned element composition and method of producing the element.

Thus, an excellent element can be obtained which satisfies simultaneously all the characteristic properties of the discharge voltage ratio $V_{10A}/V_{0.1mA}$, the varistor voltage, the deterioration ratio of the varistor voltage after applying a lightning current impulse, the switching current impulse withstanding capability and the life under electrical stress, by using the above-mentioned element composition and method of producing the element.

In the above-mentioned element composition, bismuth oxide is used in an amount of 0.5–1.2 mole %, preferably 0.6–0.9 mole %, calculated as $BiO_2O_3$. $Bi_2O_3$ forms a grain boundary layer between ZnO grains and is considered as an important additive participating with formation of a Schottkey barrier which relates to development of characteristic properties of the varistors.

If the amount of $Bi_2O_3$ is less than 0.5 mole %, the lightning current impulse withstanding capability is decreased, while if it exceeds 1.2 mole %, the deterioration rate of the discharge voltage $V_{0.1mA}$ after applying a lightning current impulse (to be referred to as "$\Delta V_{0.1mA}$" hereinafter) is increased.

Cobalt oxide is used in an amount of 0.3–1.5 mole %, preferably 0.5–1.2 mole %, calculated as $Co_2O_3$. Manganese oxide is used in an amount of 0.2–0.8 mole %, preferably 0.3–0.7 mole %, calculated as $MnO_2$. A portion of $Co_2O_3$ and $MnO_2$ is solid soluted into ZnO grains while a portion of $Co_2O_3$ and $MnO_2$ is precipitated at the grain boundary layer of ZnO grains to increase the height of the Schottkey barrier. $Co_2O_3$ and $MnO_2$ are considered to participate in stability of the Schottkey barrier. If the amount of $Co_2O_3$ is less than 0.3 mole %, $\Delta V_{0.1mA}$ after applying a lightning current impulse is increased, while if it exceeds 1.5 mole %, $\Delta V_{0.1mA}$ after applying a lightning current impulse is also increased. If the amount of $MnO_2$ is less than 0.2 mole %, the life under electric stress is deteriorated, while if it exceeds 0.8 mole %, the life under electric stress is also deteriorated.

Antimony oxide is used in an amount of 0.5–1.5 mole %, preferably 0.8–1.2 mole %, calculated as $Sb_2O_3$. Chromium oxide is used in an amount of 0.1–1.5 mole %, preferably 0.3–1.0 mole %, calculated as $Cr_2O_3$. $Sb_2O_3$ or $Cr_2O_3$ reacts with ZnO to form a spinel phase thereby suppressing extraordinary development of ZnO grains to improve homogeneity of the sintered body of the element. If the amount of $Sb_2O_3$ is less than 0.5 mole %, $\Delta V_{0.1mA}$ after applying a lightning current impulse is deteriorated and the lightning current impulse withstanding capability is deteriorated, while if it exceeds 1.5 mole %, $\Delta V_{0.1mA}$ after applying a lightning current impulse is also deteriorated, the switching current impulse withstanding capability is deteriorated, and the lightning current impulse withstanding capability is deteriorated. If the amount of $Cr_2O_3$ is less than 0.1 mole %, $\Delta V_{0.1mA}$ after applying a lightning current impulse is also deteriorated, while if it exceeds 1.5 mole %, $\Delta V_{0.1mA}$ after applying a lightning current impulse becomes also bad.

Silicon oxide is used in an amount of 0.6–2.0 mole %, preferably 0.7–1.4 mole %, calculated as $SiO_2$. $SiO_2$ has a function of precipitating in the grain boundary layer to suppress development of ZnO grains. Preferably, non-crystalline silica is used, because it improves reactivity of the composition to improve characteristic properties of the elements. If the amount of $SiO_2$ is less than 0.6 mole %, the lightning current impulse withstanding capability is deteriorated while if it exceeds 2.0 mole %, the lightning current impulse withstanding capability and $\Delta V_{0.1mA}$ after applying a lightning current impulse are deteriorated.

Nickel oxide is used in an mount of 0.8–2.5 mole %, preferably 1.0–1.5 mole %, calculated as NiO. The addition of NiO is effective in improving $\Delta V_{0.1mA}$ after applying a lightning current impulse as well as the discharge voltage ratio $V_{5kA}/cm2/V_{0.1mA}/cm2$ (to be referred to as "$V_{5kA}/V_{0.1mA}$", hereinafter) at large current area. If the amount of NiO is less than 0.8 mole %, $\Delta V_{0.1mA}$ after applying a lightning current impulse and the discharge voltage ratio $V_{5kA}/V_{1.0mA}$ at large current area are not improved, while if it exceeds 2.5 mole %, $\Delta V_{0.1mA}$ after applying a lightning current impulse becomes conversely bad and the switching current impulse withstanding capability is deteriorated.

Aluminum oxide is used in an amount of not more than 0.02 mole %, preferably 0.002–0.01 mole %, calculated as $Al_2O$. $Al_2O_3$ forms a solid solution with the ZnO grains to decrease the resistance of the ZnO grains thereby improving the discharge voltage ratio $V_{5kA}/V_{0.1mA}$ at large current area as well as the lightning current impulse withstanding capability. Also, $Al_2O_3$ has a function of improving dielectric property of the element. However, if the amount of $Al_2O_3$ is increased, voltage-current characteristic (V-I) property of the element at small current area is deteriorated ($V_{0.1mA}V_{\mu m}$ is increased) and $\Delta V_{0.1mA}$ after applying a lightning current impulse becomes bad. If the amount of $Al_2O_3$ exceeds 0.02 mole %, the discharge voltage ratio $V_{5kA}/V_{0.1mA}$ at large current area can not be improved anymore, the lightning current impulse withstanding capability is decreased, and $\Delta V_{0.1mA}$ after applying a lightning current impulse is deteriorated.

Boron oxide is used in an amount of 0.0001–0.05 mole %, preferably 0.001–0.03 mole %, calculated as $B_2O_3$. Silver oxide is used in an amount of 0.001–0.05 mole %, preferably 0.002–0.03 mole %, calculated as $Ag_2O$. Both the $B_2O_3$ and $Ag_2O$ have a function of stabilizing the grain boundary layer of ZnO grains. Preferably, they are added in a form of bismuth borosilicate glass containing Ag to the element composition, wherein another metal oxide, such as ZnO, etc., may be contained. If the amount of $B_2O_3$ is less than 0.0001 mole %, the function of $B_2O_3$ of improving the life of the element under electric stress is small, while if it exceeds 0.05 mole %, $\Delta V_{01.mA}$ after applying a lightning current impulse is deteriorated. If the amount of $Ag_2O$ is less than 0.001 mole %, the effect of $Ag_2O$ of improving $\Delta$V0.1mA after applying a lightning current impulse is small, while if it exceeds 0.05 mole %, $\Delta V_{0.1mA}$ after applying a lightning current impulse is conversely deteriorated.

The reason for defining the discharge voltage $V_{0.1mA}$ as 230–330 V/mm (preferably 240–280 V/mm) at a current density of 0.1 mA/cm$^2$ is because at a discharge voltage $V_{0.1mA}$ of less than 230 V/mm, aimed miniaturization of gapless lightning arrestors, etc., can not be achieved, and the deterioration rate of the discharge voltage after applying a lightning current impulse becomes large. At a discharge voltage $V_{0.1mA}$ exceeding 330 V/mm, the lightning current impulse withstanding capability is decreased.

In order to produce the voltage non-linear resistor of the first aspect of the present invention, the above-mentioned composition is sintered at 1,130°–1,240° C. If the sintering temperature exceeds 1,240° C., the pores in the resistor or element are increased to decrease the lightning current impulse withstanding capability, while if it less than 1,130° C., the sintering of the sintered body becomes insufficient to decrease the lightning current impulse withstanding capability, so that the sintering of the composition is effected at a temperature of 1,130°–1,240° C. discharge voltage $\Delta V_{0.1mA}$ (twice applying a lightning current impulse of a current density of 5 kA/cm$^2$, 4/10 μs waveform) is limited to be not more than 10% (preferably not more than 5%) is because, if it exceeds 10%, the number of elements has to be increased to compensate for the deterioration of the discharge voltage, thereby increasing the length of the lightning arrestor in the longitudinal direction thereof.

In order to make the deterioration rate of the discharge voltage $\Delta V_{0.1mA}$ a value of not more than 10%, the above-mentioned composition is (1) finally heat treated at a temperature of not less than 400° C. preferably for at least 0.5 hr (more preferably at least 1 hr), using an amount of $Al_2O_3$ in the composition of not more than 0.02 mole %, and (2) the mixture of Al and ZnO is calcined at a temperature of 500°–1,000° C., preferably 600°–900° C.

In order to make the deterioration rate of the discharge voltage $\Delta V_{0.1mA}$ a value of not more than 5%, the above mentioned composition is (1) finally heat treated at a temperature of not less than 450° C. preferably for at least 0.5 hr (more preferably for at least 1 hr), using an amount of $Al_2O_3$ in the composition of not more than 0.01 mole %, (2) the mixture of Al and ZnO is calcined at a temperature of 500°–1,000° C., preferably 600°–900° C., and (3) the calcined product of ZnO and Al is mixed in an atlighter with a pulverized mixture of the other metal oxides.

When the mixing is effected in an atlighter, ZnO grains in solid solution with Al are uniformly mixed and dispersed with the other metal oxides, so that homogeneity of the element is improved and good electrical properties can be obtained. Particularly, the deterioration rate of the discharge voltage after applying a lightning current impulse is improved or made small.

The reason why the discharge voltage ratio $V_{0.1mA}/V_{1\mu A}$ defined as a value of not more than 1.4 is because, if it exceeds 1.4, a leak current flowing through the resistor when applying an electric current thereon is increased to cause the resistor to thermally run away and destruct the resistor.

In order to make the discharge voltage ratio $V_{0.1mA}/V_{1\mu A}$ a value of not more than 1.4, the above-described composition using an $Al_2O_3$ amount of not more than 0.02 mole % is finally heat treated at a temperature of not less than 400° C. and less than 530° C. preferably for at least 0.5 hr (more preferably at least 1 hr).

In order to make the discharge voltage ratio $V_{0.1mA}/V_{1\mu A}$ value of not more than 1.35, the above-described composition using an $Al_2O_3$ amount of not more than 0.01 mole % is finally heat treated at a temperature of 450°–510° C. preferably for at least 0.5 hr (more preferably at least 1 hr).

The discharge voltage ratio $V_{10A}V_{0.1mA}$ at current densities of 10 A/cm$^2$ and 0.1 mA/cm$^2$ is preferably 1.25–1.45, more preferably 1.30–1.40. In this range, the switching current impulse withstanding capability of the element is acceptable and if it is less than 1.25, the switching current impulse withstanding capability is not increased, while if it exceeds 1.45, the discharge voltage ratio $V_{5kA}/V_{0.1mA}$ at large current area is deteriorated and the lightning current impulse withstanding capability is decreased.

In order to make $V_{10A}/V_{0.1mA}$ a Value of 1.25–1.45, the above-described composition is used wherein $Al_2O_3$ is used in an amount of not more than 0.02 mole %, $B_2O_3$ is used in an amount of 0.0001–0.05 mole %, and $Ag_2O$ is used in an amount of 0.001–0.05 mole %.

In order to make $V_{10A}/V_{0.1mA}$ a value of 1.30–1.40, the above-described composition is used wherein $Al_2O_3$ is used in an amount of not more than 0.01 mole %, $B_2O_3$ is used in an amount of 0.001–0.03 mole %, and $Ag_2O$ is used in an amount of 0.002–0.03 mole %.

$V_{5kA}/V_{0.1mA}$ at large current area is preferably not more than 2.60, more preferably not more than 2.45. In this way, the lightning current impulse withstanding capability is further increased and the length of the lightning arrestor in longitudinal direction thereof can further be shortened. For that purpose, $Al_2O_3$ is preferably used in an amount of not less than 0.002 mole %, more preferably not less than 0.003 mole % in the above-described composition.

In order to obtain the voltage non-linear resistor of the first aspect of the present invention, the method of the second aspect of the present invention is performed, and at first a calcination of Al and ZnO is effected.

Namely, zinc oxide is preliminarily mixed with a solution containing a desired amount of aluminum, and the resultant mixture is spray dried and calcined, and the calcined mixture is mixed with the other metal oxides in order to improve $\Delta V_{0.1mA}$ after applying a lightning current impulse, the lightning current impulse withstanding capability, the switching current impulse withstanding capability, the discharge voltage ratio at large current area, and the life under electrical stress, of the element. In this case, the following functions and effects can be obtained:

(1) Because aluminum in solution is mixed with zinc oxide, aluminum of atom level is solid soluted into zinc oxide, so that homogeneity of aluminum in zinc oxide can be improved and resistance of zinc oxide grains can be largely decreased. The solution of aluminum is preferably an aqueous solution, such as an aqueous solution of nitrate or chloride, etc., of aluminum. Content of solid substance in the mixed solution is preferably 50–75 wt%.

(2) Because the mixed solution or mixture slurry is spray dried to instantly remove moisture therefrom, a dried product having a uniform distribution of aluminum concentration can be obtained, so that homogeneity of the dried product can be improved. In this case, if the mixture slurry is slowly dried in a vat, etc., an undesirable effect takes place of incurring uneven concentration of zinc oxide and aluminum. Spray drying temperature is preferably 200°–500° C.

(3) Because the dried powder is calcined, aluminum is uniformly and sufficiently solid soluted into zinc oxide grains.

In conventional methods, aluminum is solid soluted into zinc oxide by means of sintering a mixture of zinc oxide and metal oxides including aluminum oxide, so that aluminum is not sufficiently solid soluted into zinc oxide and remains in the grain boundary layer of zinc oxide grains to cause adverse influences over the discharge voltage after applying a lightning current impulse, the lightning current impulse withstanding capability, the switching current impulse withstanding capability and the life of the element under electrical stress.

Calcining temperature is preferably 500°–1,000° C., more preferably 600°–900° C. If it is less than 500° C., aluminum is not sufficiently solid soluted into zinc oxide, while if it exceeds 1,000° C., sintering of zinc oxide rapidly proceeds.

More specifically, at first a source material of zinc oxide prepared to a fineness of around 0.5 μm, a solution containing a desired amount of aluminum (such as aqueous solution of aluminum nitrate, etc.), and a desired dispersant, etc., are mixed, and the thus obtained mixture is dried, for example, by spray drying using a spray drier, to obtain a dry powder. Then, the dry powder is calcined at a temperature of 500°–1,000° C., preferably in an oxidizing atmosphere, to obtain a raw material of zinc oxide of a desired fineness of preferably not more than 3 μm, more preferably not more than 1 μm. The thus obtained raw material of zinc oxide is preferably pulverized. Thereafter, the raw material of zinc oxide is mixed with a desired amount of an addition mixture consisting of bismuth oxide, cobalt oxide, manganese oxide, antimony oxide, chromium oxide, silicon oxide, nickel oxide, silver oxide, and boron oxide, etc. In this case, silver nitrate and boric acid may be used instead of silver oxide and boron oxide, etc., prepared to desired finenesses. Preferably, bismuth borosilicate glass containing silver is used.

The mixture of powders of these raw materials is added with a desired amount of binder (preferably an aqueous solution of polyvinyl alcohol) and a dispersant, etc., mixed in a disperser mill, preferably in an atlighter, and granulated preferably by a spray dryer to obtain granulates which are then formed into a desired shape under a shaping pressure of 800–20,000 kg/cm$^2$. The formed body is calcined at a condition of a heating or cooling rate of 30°–70° C./hr, a temperature of 800°–1,000° C., and a holding time of 1–5 hrs.

The mixing of the slurry in the atlighter is preferably effected using zirconia balls as a mixing medium, a stabilized zirconia member as an agitator arm, and an organic resin (preferably nylon resin) as a lining of the atlighter tank, for minimizing the contamination of the mixture of powders during the mixing. Preferably, the slurry temperature is controlled so as not to exceed 40° C. for preventing gelation of the mixture slurry, and efficiently and homogeneously dispersing and mixing zinc oxide with the other metal oxides. Mixing time is preferably 1–10 hrs, more preferably 2–5 hrs. Zirconia balls as a mixing medium are preferably made of zirconia stabilized with yttrium oxide $Y_2O_3$, though zirconia stabilized with magnesium oxide MgO or calcium oxide CaO can be used.

Preferably, the formed body before calcination is heated at a heating or cooling rate of 10°–100° C./hr to a temperature of 400°–600° C. for 1–10 hrs to dissipate and remove the binder.

The term ∓green body" used herein means the formed, degreased (formed body from which the binder is removed) and calcined body.

Next, a highly resistive side layer is formed on a side of the calcined body. For that purpose, a desired amount of bismuth oxide, antimony oxide, silicon oxide, and zinc oxide, etc., is added with an organic binder, such as, ethyl cellulose, butyl carbitol, n-butyl acetate, etc., to prepare a mixture paste for the highly resistive side layer, and the paste is applied on the side of the calcined body to a thickness of 60–300 μm. Alternatively, the paste may be applied on the formed body or the degreased body. Then, the calcined body with the applied paste is sintered with a heating or cooling rate of 20°–100° C./hr (preferably 30°–60° C./hr) to 1,130°–1,240° C. and held thereat for 3–7 hrs.

Then, the sintered body is finally heat treated with a heating or cooling rate of not more than 200° C./hr at a temperature ranging from 400° C. to less than 530° C. for preferably at least 0.5 hr (more preferably at least 1 hr). The heat treatment may be repeated plural times.

In one aspect, a glass layer may simultaneously be formed on the highly resistive side layer by a heat treatment of applying a glass paste consisting of a glass powder and an organic binder, such as, ethyl cellulose, butyl carbitol, or n-butyl acetate, etc., on the highly resistive side layer to a thickness of 100–300 μm, and heat treating it in air with a heating or cooling rate of not more than 200° C./hr at 400°–600° C. for a holding time of at least 0.5 hr.

Thereafter, both end surfaces of the thus obtained voltage non-linear resistor body are polished by a polisher, such as, diamond, etc., of a mesh responding to #400-#2,000 using water or oil. Then, the polished end surfaces are rinsed to remove the polisher and the like, and provided with electrodes made of, e.g., aluminum, by means of, for example, thermal melt spray to obtain a voltage non-linear resistor body.

A material other than the aforementioned composition according to the present invention can of course be added to the composition depending on aimed use and purpose of the voltage non-linear resistor, if such material does not largely damage the effects of the resistor.

In addition to satisfy the above characteristic properties, suspension type lightning arrestors should desirably be further miniaturized. A suspension type lightning arrestor having voltage non-linear resistors inserted between vertically joined insulator bodies for imparting the insulator bodies with a lightning arresting function (refer to attached FIG. 1) calls for even shorter voltage non-linear resistors, particularly in the longitudinal direction of the arrestor, because the voltage non-linear resistors have to be newly inserted between the insulator bodies.

In the third aspect of the present invention, the present invention is a voltage non-linear resistor containing zinc oxide as a main component and subsidiary components of (a) 0.3-1.1 mole % of bismuth oxide calculated as $Bi_2O_3$,
(b) 0.3-1.5 mole % of cobalt oxide calculated as $Co_2O_3$,
(c) 0.2-0.8 mole % of manganese oxide calculated as $MnO_2$,
(d) 0.5-1.5 mole % of antimony oxide calculated as $Sb_2O_3$,
(e) 5.0-10.0 mole % of silicon oxide calculated as $SiO_2$,
(f) 0.8-2.5 mole % of nickel oxide calculated as NiO,
(g) not more than 0.02 mole % of aluminum oxide calculated as $Al_2O_3$,
(h) 0.0001-0.05 mole % of boron oxide calculated as $B_2O_3$, and
(i) 0.001-0.05 mole % of silver oxide calculated as $Ag_2O$, and the resistor having
(j) a discharge voltage $V_{0.1mA}$ of 340-550 V/mm at a current density of 0.1 mA/cm$^2$ calculated per unit thickness of the sintered resistor,
(k) a discharge voltage ratio $V_{0.1mA}V_{1\mu A}$ of not more than 1.4 at current densities of 0.1 mA/cm$^2$ *l and* 1 $\mu$A/cm$^2$.
(l) a deterioration rate of discharge voltage of not more than 10% at a current density of 0.1 mA/cm$^2$ before and after applying twice a lightning current impulse of a current density of 2.5 kA/cm$^2$ (4/10 $\mu$s wave form), and
(m) a discharge voltage ratio $V_{10A}V_{0.1mA}$ of 1.20-1.45 at current densities of 10 A/cm$^2$ and 0.1 mA/cm$^2$.

In the fourth aspect of the present invention, the present invention is a method of producing a voltage non-linear resistor, comprising, i) forming a green body of the voltage non-linear resistor body containing zinc oxide as a main component, and subsidiary components of (a) 0.3-1.1 mole % of bismuth oxide calculated as $Bi_2O_3$,
(b) 0.3-1.5 mole % of cobalt oxide calculated as $Co_2O_3$,
(c) 0.2-0.8 mole % of manganese oxide calculated as $MnO_2$,
(d) 0.5-1.5 mole % of antimony oxide calculated as $Sb_2O_3$,
(e) 5.0-10.0 mole % of silicon oxide calculated as $SiO_2$,
(f) 0.8-2.5 mole % of nickel oxide calculated as NiO,
(h) not more than 0.02 mole % of aluminum oxide calculated as $Al_2O_3$,
(i) 0.0001-0.05 mole % of boron oxide calculated as $B_2O_3$, and
(j) 0.001-0.05 mole % of silver oxide calculated as $Ag_2O$, ii) the green body being formed by mixing the main component zinc oxide with a solution containing aluminum corresponding to the amount of (h) aluminum oxide, spray drying the mixture, calcining the spray dried mixture, mixing the calcined mixture with the other metal oxides (a)-(f) and (h)-(i), granulating and forming the mixture, iii) sintering the green body at 1,070°-1,200° C., and iv) heat treating the sintered body at 400°-600° C.

For realizing the aimed miniaturization of the gapless lightning arrestor, namely, the shortening of the length and diameter of the lightning arrestor, characteristic properties of the voltage non-linear resistor which is to be accommodated in the lightning arrestor have to be improved, so as to decrease or shorten the total length of the stacked elements and diameter of the elements. Particularly, a so-called suspension type lightning arrestor having stacked plural number of elements accommodated in a shed portion of the suspension type insulator calls for decreased total length of the stacked elements. This is because the elements have to be accommodated in the shed portion of the suspension type insulator, whereby the joined length of the suspension type lightning arrestors has to meet the joined length of already installed prior suspension type insulator. In order to widely shorten the total length of the elements accommodated in a gapless lightning arrestor, such as a suspension type lightning arrestor, an element having a high varistor voltage and a very small deterioration of varistor voltage even after application of a lightning current impulse, has to be used.

A gapless lightning arrestor is usually designed with a maximum current of 0.1 mA per unit surface area (cm$^2$) of the element (unit surface area of interface of the element joining with the electrode) flowing through the arrestor or element accommodated in the arrestor when applied with a rated voltage. If a deterioration rate of the varistor voltage of the element after application of a lightning current impulse is large, the elements have to be used in large number in consideration of the large deterioration rate of the varistor voltage, so that the above-described deterioration rate of the varistor voltage is desirably small.

The inventors used the above-mentioned element composition and production method to obtain the element having a varistor voltage $V_{0.1mA}$ of at least 340 V/mm and a deterioration rate of varistor voltage of not more than 10% before and after applying twice a lightning current impulse of a current density of 2.5 kA/cm$^2$ (4/10 $\mu$s wave form). The above test condition for applying the lightning current impulse is based on the condition generally designed for testing gapless lightning arrestors.

Next, in order to shorten the length of the element in radial direction thereof, switching current impulse withstanding capability and lightning current impulse withstanding capability of the element have to be improved.

Different from gapped lightning arrestors, gapless lightning arrestors have no follow current flowing therethrough when lightning current impulse is applied. Thus, as regards discharge energy of the gapless lightning arrestors, a switching current impulse which is generated at the time of on-off of a circuit breaker is larger than a lightning current impulse. Therefore, in gapless lightning arrestors, the number of elements is determined mainly considering also the switching current impulse withstanding capability thereof, and the elements having superior switching current impulse withstanding capability have to be adopted for shortening the length of the arrestors in radial direction thereof.

The inventors obtained, by the above-mentioned composition of the element and production method, a superior element having a discharge voltage ratio $V_{10A}V_{0.1mA}$ of 1.20–1.45 at current densities of 10 A/cm$^2$ and 0.1 mA/cm$^2$ as well as a splendid switching current impulse withstanding capability.

In gapless lightning arrestors which are always applied by an electric current, improvement of the life under electric stress of the arrestors is very important in practice, and the inventors have discovered that an excellent element having a discharge voltage ratio $V_{0.1mA}/V_{1\mu A}$ of not more than 1.4 at current densities of 0.1 mA/cm$^2$ and 1 $\mu$A/cm$^2$ and an improved electric life under electrical stress, can be obtained by using the above-mentioned element composition and method of producing the element.

Thus, an excellent element can be obtained which satisfies simultaneously all the characteristic properties of the above varistor voltage, the deterioration ratio of the varistor voltage after applying a lightning current impulse, the switching current impulse withstanding capability and the life under electrical stress, by using the above-mentioned element composition and method of producing the element.

In the above-mentioned composition, bismuth oxide is used in an amount of 0.3–1.1 mole %, preferably 0.5–0.9 mole %, calculated as $BiO_2O_3$. $Bi_2O_3$ forms a grain boundary layer between ZnO grains and is considered as an important additive participating with the formation of a Schottkey barrier which relates to development of characteristic properties of the varistors.

If the amount of $Bi_2O_3$ is less than 0.3 mole %, lightning current impulse withstanding capability is decreased and the discharge voltage ratio $V_{10A}/V_{0.1mA}$ is increased. If it exceeds 1.1 mole %, deterioration rate $\Delta V_{0.1mA}$ of the discharge voltage $V_{0.1mA}$ after applying a lightning current impulse is increased.

Cobalt oxide is used in an amount of 0.3–1.5 mole %, preferably 0.5–1.2 mole %, calculated as $Co_2O_3$. Manganese oxide is used in an amount of 0.2–0.8 mole %, preferably 0.3–0.7 mole %, calculated as $MnO_2$. A portion of $Co_2O_3$ and $MnO_2$ is solid soluted into ZnO grains while a portion of $Co_2O_3$ and $MnO_2$ is precipitated at the grain boundary layer of ZnO grains to increase the height of the Schottkey barrier. $Co_2O_3$ and $MnO_2$ are considered to participate in stability of the Schottkey barrier If the amount of $Co_2O_3$ is less than 0.5 mole %, $\Delta V_{0.1mA}$ after applying a lightning current impulse is increased, while if it exceeds 1.5 mole %, $\Delta V_{0.1mA}$ after applying a lightning current impulse is also increased. If the amount of $MnO_2$ is less than 0.2 mole %, the life under electrical stress is deteriorated, while if it exceeds 0.8 mole %, the life under electrical stress is deteriorated.

Antimony oxide is used in an amount of 0.5–1.5 mole %, preferably 0.8–1.2 mole %, calculated as $Sb_2O_3$. Chromium oxide is preferably used in an amount of 0.1–1.0 mole %, more preferably 0.3–0.7 mole %, calculated as $Cr_2O_3$. $Sb_2O_3$ or $Cr_2O_3$ reacts with ZnO to form a spinel phase thereby plays a function of suppressing extraordinary development of ZnO grains to improve homogeneity of the sintered body of the element. If the amount of $Sb_2O_3$ is less than 0.5 mole %, $\Delta V_{0.1mA}$ after applying a lightning current impulse is deteriorated and the lightning current impulse withstanding capability is deteriorated, while if it exceeds 1.5 mole %, $\Delta V_{0.1mA}$ after applying a lightning current impulse is also deteriorated, the switching current impulse withstanding capability is deteriorated, and the lightning current impulse withstanding capability is deteriorated. If the amount of $Cr_2O_3$ is less than 0.1 mole %, $\Delta V_{0.1mA}$ after applying a lightning current impulse is somewhat deteriorated, while if it exceeds 1.0 mole %, $\Delta V_{0.1mA}$ after applying a lightning current impulse is somewhat deteriorated, so that an amount of 0.1–1.0 mole % is preferable.

Silicon oxide is used in an amount of 5.0–10.0 mole %, preferably 6.0–9.0 mole %, calculated as $SiO_2$. $SiO_2$ has a function of precipitating in the grain boundary layer to suppress development of ZnO grains. Therefore, the amount of $SiO_2$ has to be increased for increasing the discharge voltage $V_{0.1mA}$. Preferably, non-crystalline silica is used, because it improves reactivity of the composition to improve characteristic properties of the elements. If the amount of $SiO_2$ is less than 5.0 mole %, $\Delta V_{0.1mA}$ after applying a lightning current impulse is deteriorated, and sintering temperature at the time of sintering the formed calcined composition has to be widely decreased for obtaining $V_{0.1mA}$ of not less than 340 V/mm, so that the sintering of the sintered body becomes insufficient and the lightning current impulse withstanding capability is decreased. While, if it exceeds 10.0 mole %, the switching current impulse withstanding capability and the lightning current impulse withstanding capability and $\Delta V_{0.1mA}$ after applying a lightning current impulse is deteriorated and the life under electric stress are deteriorated.

Nickel oxide is used in an mount of 0.8–2.5 mole %, preferably 1.0–1.5 mole %, calculated as NiO. The addition of NiO is effective in improving $\Delta V_{0.1mA}$ after applying a lightning current impulse as well as a discharge voltage ratio $V_{2.5kA}/V_{0.1mA}$ at large current area. If the amount of NiO is less than 0.8 mole %, $\Delta V_{0.1mA}$ after applying a lightning current impulse and the discharge voltage ratio $V_{2.5kA}/V_{0.1mA}$ at large current area are not improved, while if it exceeds 1.5 mole %, $\Delta V_{0.1mA}$ after applying a lightning current impulse is deteriorated and the switching current impulse withstanding capability becomes conversely bad.

Aluminum oxide is used in an amount of not more than 0.02 mole %, preferably 0.002–0.01 mole %, more preferably 0.003–0.01 mole %, calculated as $Al_2O_3$. $Al_2O_3$ has a function of solid soluting into ZnO grains to decrease the resistance of the ZnO grains thereby to improve the discharge voltage ratio $V_{2.5ka}/V_{0.1mA}$ at large current area as well as the lightning current impulse withstanding capability. Also, $Al_2O_3$ has a function of improving dielectric property of the element. However, if the amount of $Al_2O_3$ is increased, voltage-current characteristic property of the element at minor current area is deteriorated ($V_{0.1mA}/V_{1\mu m}$ increased) and $\Delta V_{0.1mA}$ after applying a lightning current impulse is deteriorated. If the amount of $Al_2O_3$ exceeds 0.02 mole %, the discharge voltage ratio $V_{2.5kA}/V_{0.2mA}$ at large current area can not be improved anymore, the lightning current impulse withstanding capability is decreased, and $\Delta V_{0.1mA}$ after applying a lightning current impulse is deteriorated.

Boron oxide is used in an amount of 0.0001–0.05 mole %, preferably 0.001–0.03 mole %, calculated as $B_2O_3$. Silver oxide is used in an amount of 0.001–0.05 mole %, preferably 0.002–0.03 mole %, calculated as $Ag_2O$. Both the $B_2O_3$ and $Ag_2O$ have a function of stabilizing the grain boundary layer of ZnO grains. Preferably, they are added in a form of bismuth borosilicate glass containing Ag to the element composition, wherein another metal oxide, such as ZnO, etc., may be contained. If the amount of $B_2O_3$ is less than 0.0001 mole %, the function of $B_2O_3$ of improving the life of the element under electrical stress is small, while if it exceeds 0.05 mole %, $\Delta V_{0.1mA}$ after applying a lightning current impulse is deteriorated. If the amount of $Ag_2O$ is less than 0.001 mole %, the effect of $Ag_2O$ of improving $\Delta V_{0.1mA}$ after applying a lightning current impulse is small, while if it exceeds 0.05 mole %, $\Delta V_{0.1mA}$ after applying a lightning current impulse is conversely deteriorated.

The reason for defining the discharge voltage $V_{0.1mA}$ as 340–550 V/mm (preferably 400–500 V/mm) at a current density of 0.1 mA/cm$^2$ is because at a discharge voltage $V_{0.1mA}$ of less than 340 V/mm the aimed miniaturization of suspension type lightning arrestors, etc., can not be achieved, and an elevated sintering temperature has to be used at a $V_{0.1mA}$ of less than 340 V/mm for the above-described element composition and such elevated sintering temperature causes the porosity of the sintered element to increase and the lightning current impulse withstanding capability and the switching current impulse withstanding capability to decrease, and the sintering temperature is decreased at a $V_{0.1mA}$ of exceeding 550 V/mm so that the sintering of the sintered body becomes insufficient and the lightning current impulse withstanding capability is decreased.

In order to produce the voltage non-linear resistor of the third aspect of the present invention, the above-mentioned composition is sintered at 1,070°–1,200° C. If the sintering temperature exceeds 1,200° C., the pores in the resistor or element are increased to decrease the lightning current impulse withstanding capability, while if it less than 1,070° C., the sintering of the sintered body becomes insufficient to decrease the lightning current impulse withstanding capability.

The reason why the deterioration rate $\Delta V_{0.1mA}$ of the discharge voltage (twice applying a lightning current impulse of a current density of 2.5 kA/cm$^2$, 4/10 μs waveform) to not more than 10% (preferably not more than 5%) is because, if it exceeds 10%, the number of the elements has to be increased for compensating the deterioration of the discharge voltage thereby to increase the length of the lightning arrestor in the longitudinal direction thereof.

In order to make the deterioration rate of the discharge voltage $\Delta V_{0.1mA}$ a value of not more than 10%, the above-mentioned composition is (1) finally heat treated at a temperature of not less than 400° C. preferably for at least 0.5 hr (more preferably at least 1 hr), using an amount of $Al_2O_3$ in the composition of not more than 0.02 mole %, and (2) the mixture of Al and ZnO is calcined at a temperature of 500°–1,000° C., preferably 600°–900° C.

In order to make the deterioration rate of the discharge voltage $\Delta V_{0.1mA}$ a value of not more than 5%, the above-mentioned composition is (1) finally heat treated at a temperature of not less than 450° C. preferably for at least 0.5 hr (more preferably for at least 1 hr), using an amount of $Al_2O_3$ in the composition of not more than 0.01 mole %, (2) the mixture of Al and ZnO is calcined at a temperature of 500°–1,000° C., preferably 600°–900° C., and (3) the calcined product of ZnO and Al is mixed in an atlighter with a pulverized mixture of the other metal oxides.

When the mixing is effected in an atlighter, ZnO grains solid soluted with Al are uniformly mixed and dispersed with the other metal oxides, so that homogeneity of the element is improved and good electrical properties can be obtained. Particularly, the deterioration rate of the discharge voltage after applying a lightning current impulse is improved or made small.

The reason why the discharge voltage ratio $V_{0.1mA}/V_{1\mu A}$ defined as a value of not more than 1.4 is because, if it exceeds 1.4, a leak current flowing through the resistor when applying an electric current thereon is increased to cause the resistor to thermally run away and destruct the resistor.

In order to make the discharge voltage ratio $V_{0.1mA}V_{1\mu A}$ a value Of not more than 1.4, the above-described composition using an $Al_2O_3$ amount of not more than 0.02 mole % is finally heat treated at a temperature of exceeding 400° C. and less than 600° C. preferably for at least 0.5 hr (more preferably for at least 1 hr).

In order to make the discharge voltage ratio $V_{0.1mA}V_{1\mu A}$ a value of not more than 1.35, the above-described composition using an $Al_2O_3$ amount of not more than 0.01 mole % is finally heat treated at a temperature of 450°–550° C. preferably for at least 0.5 hr (more preferably at least 1 hr).

The discharge voltage ratio $V_{10A}/V_{0.1mA}$ at current densities of 10 A/cm$^2$ and 0.1 mA/cm$^2$ is preferably 1.20–1.45, more preferably 1.25–1.40. In this range, the switching current impulse withstanding capability of the element is improved. If it is less than 1.20, the switching current impulse withstanding capability is not improved, while if it exceeds 1.45, the discharge voltage ratio $V_{2.5kA}V_{0.1mA}$ (abbreviation of $V_{2.5kA}$cm$^2$/$V_{0.1mA}$/cm$^2$) at large current area is deteriorated and the lightning current impulse withstanding capability is decreased.

In order to make $V_{10A}/V_{0.1mA}$ a value of 1.20–1.45, the above-described composition is used wherein $Al_2O_3$ is used in an amount of not more than 0.02 mole %, $Bi_2O_3$ is used in an amount of not less than 0.3 mole %, and $Ag_2O$ is used in an amount of not more than 0.05 mole %.

In order to make $V_{10A}/V_{0.1mA}$ a value of 1.24–1.45, the above-described composition is used wherein $Al_2O_3$ is used in an amount of 0.002–0.01 mole %, $Bi_2O_3$ used in an amount of not less than 0.3 mole %, and $Ag_2O$ is used in an amount of 0.002–0.05 mole %.

The $V_{2.5kA}/V_{0.1mA}$ at large current area is preferably not more than 2.35, more preferably not more than 2.25. In this way, the lightning current impulse withstanding capability is further increased and the length of the lightning arrestor in longitudinal direction thereof can further be shortened. For that purpose, $Al_2O_3$ is used in an amount of not less than 0.002 mole %, more preferably not less than 0.003 mole % in the above-described composition.

In order to obtain the voltage non-linear resistor of the third aspect of the present invention, the method of the fourth aspect of the present invention is effected which is substantially the same manner as concretely described above about the second aspect of the present invention, except that the sintering temperature is 1,070°-1,200° C. and the heat treatment temperatures for heat treating the sintered body and the glass paste are respectively at 400°-600° C. (preferably 450°-550° C.). In case of mixing, the addition mixture containing silicon oxide is preferably partly or wholly calcined at 600°-900° C. and then finely pulverized (preferably to not more than 2 μm) before mixing with the raw material of zinc oxide, because the present resistor has a composition of a large content of silicon oxide so that the silicon oxide is apt to gelate at the time of mixing with the raw material of zinc oxide and effect an adverse influence over the homogeneity of the element.

Similarly as in the second aspect of the present invention, a material other than the aforementioned composition of the fourth aspect of the present invention can of course be added to the composition depending on aimed use and purpose of the voltage non-linear resistor, if such material does not largely damage the effects of the resistor.

BRIEF DESCRIPTION OF THE DRAWINGS

For a better understanding of the present invention, reference is made to the accompanying drawings, in which.

Figure 1:
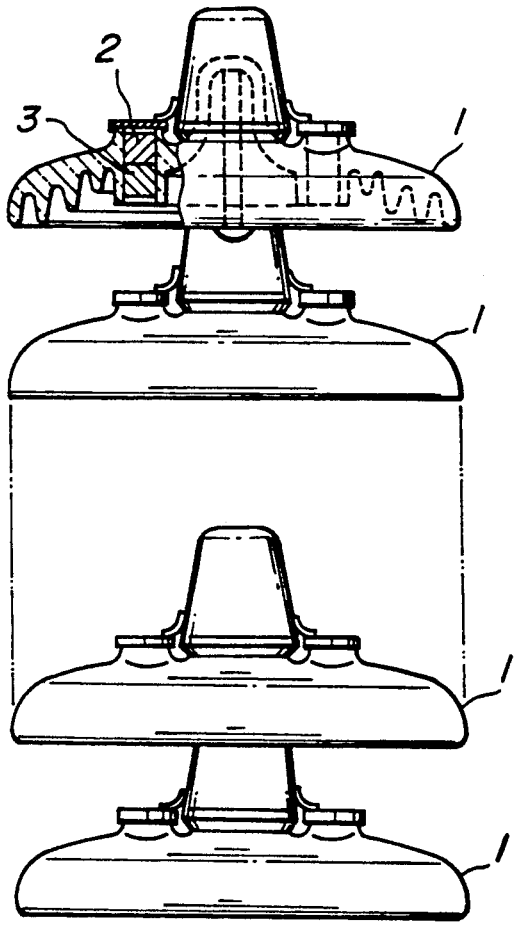
FIG. 1 is a schematic side view partially in cross-section of a suspension type lightning arrestor.
Figure 2:
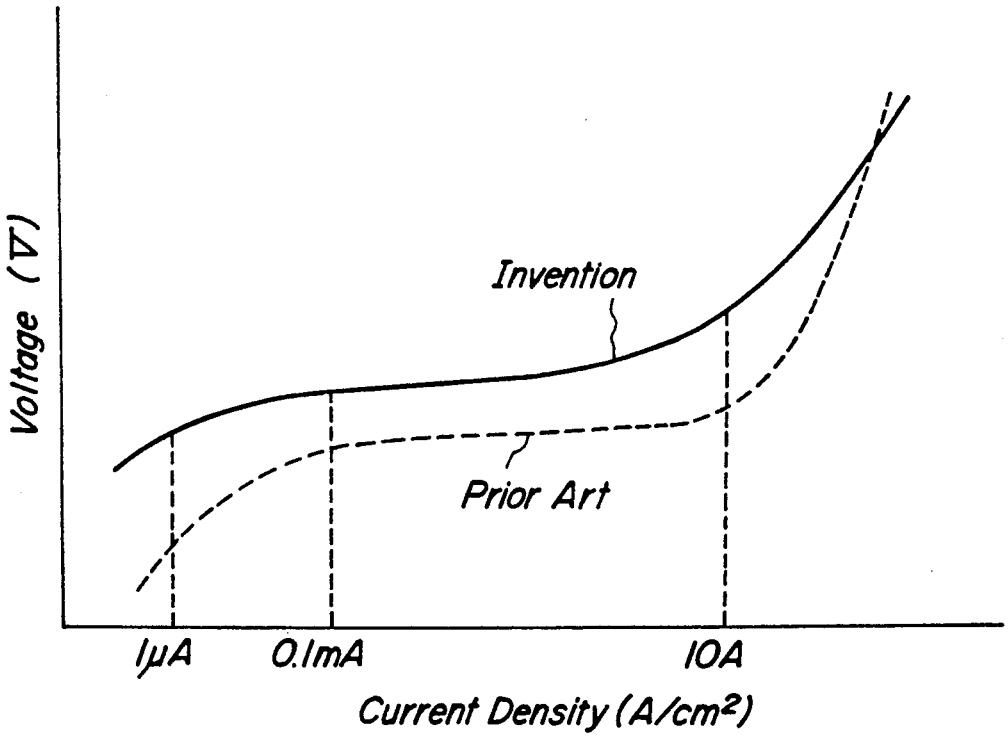
FIG. 2 is a characteristic graph showing a voltage-current property of a conventional voltage non-linear resistor and a voltage-current property of the present voltage non-linear resistor.

Numerals in the Drawings 1 suspension type insulator body.

2 resistor or element.

3 resistor or element.

DESCRIPTION OF THE PREFERRED EMBODIMENTS

Hereinafter, the present invention will be explained in more detail with reference to examples.

EXAMPLES 1-61 AND COMPARATIVE EXAMPLES 1-29

Green bodies of compositions as shown in the later-described Table 1 are treated in the production conditions as shown in Table 1 to produce voltage non-linear resistor bodies of a size of ϕ47 mm×h22.5 mm of Examples 1-61 and Comparative Examples 1-29. Characteristic properties of these resistors are shown in Table 1.

In the compositions of the voltage non-linear resistor bodies shown in Table 1, amorphous silica is used as silica and $B_2O_3$ and $Ag_2O$ are used after vitrification.

The calcination of Al and ZnO is effected by using and mixing an aqueous solution of aluminum nitrate and zinc oxide, spray drying the mixture at 300° C., and calcining the spray dried mixture at 700° C. The calcined products are pulverized in a pot mill, etc., to an average particle diameter of not more than 1 μm.

The other metal oxides are calcined at 800° C. for 5 hrs, and finely pulverized to an average particle diameter of not more than 2 μm.

The mixing of ZnO and the other metal oxides is effected mainly in an atlighter for 3 hrs using zirconia balls stabilized by yttrium oxide. When the atlighter is not used, a disperser mill is used for the mixing for 3 hrs.

The sintering is effected at temperatures as shown in Table 1 for a holding time of 5 hrs.

The final heat treatment is effected at temperatures as shown in Table 1 for a holding time of 0.5-2 hrs.

As for electric characteristic properties, the discharge voltage (expressed by $V_{0.1A}$, unit is V/mm). the discharge voltage ratio (expressed by $V_{10A}/V_{0.1mA}$ and $V_{0.1mA}/V_{1\mu A}$), the deterioration rate of discharge voltage before and after applying twice (at an interval of 5 min) a lightning current impulse (4/10 μs waveform) of 2.5 kA/cm$^2$ or 5 KA/cm$^2$ (expressed by $\Delta V_{0.1mA}$, unit is %), the switching current impulse withstanding capability, the lightning current impulse withstanding capability, and the life under electric stress, are evaluated.

The switching current impulse withstanding capability is a withstanding capability against applying 20 times a current impulse of an electric waveform of 2 ms, and expressed by an energy value (calculated by current×voltage×applied time, cleared value, unit is kilo Joule (KJ)) or ampere.

The lightning current impulse withstanding capability as withstanding capability against twice applying a current impulse of an electric waveform of 4/10 μs, and expressed by an energy value (calculated by current×voltage×applied time, cleared value, unit is kilo Joule (KJ)). If the switching current impulse withstanding capability and the lightning current impulse withstanding capability are evaluated by a value of current, correct evaluations thereof are impossible, because a voltage to be applied on the resistor element becomes higher with the increase of $V_{0.1mA}$ of the resistor element and hence the current value of withstanding a current impulse becomes a low value.

The life under electric stress is calculated by Arrhenius plot. Resistor elements having a life under electric stress of at least 100 years at a current applying rate of 85% at 40° C. are expressed with a symbol ○, those having a life of at least 300 years with a symbol ◎, and those having a life of not reaching 100 years with a symbol X.

The above values are not influenced by a size of the voltage non-linear resistor bodies. For instance, similar results were obtained when the resistor bodies have a disc shape of a diameter of 70 mm.

TABLE 1

| Item | Element composition (mole %) | | | | | | | | | | Producing method | | | | Characteristic properties | | | | | | |
|---|---|---|---|---|---|---|---|---|---|---|---|---|---|---|---|---|---|---|---|---|---|
| | $Bi_2O_3$ | $Co_2O_3$ | $MnO_2$ | $Sb_2O_3$ | $Cr_2O_3$ | NiO | $SiO_2$ | $Al_2O_3$ | $B_2O_3$ | $Ag_2O$ | Calcining of Al and ZnO | Mixing in atlighter | Sintering (°C.) | Heat treatment (°C.) | $V_{0.1mA}$ | $\Delta V_{0.1mA}$ | $V_{10A}/V_{0.1mA}$ | $V_{0.1mA}/V_{1\mu A}$ | Switching capability (A) | Life | Lightning capability (KJ) |
| Example | | | | | | | | | | | | | | | | | | | | | |
| 1 | 0.5 | 1.0 | 0.5 | 1.0 | 0.5 | 1.3 | 1.0 | 0.005 | 0.005 | 0.01 | yes | yes | 1210 | 500 | 255 | 6.3 | 1.32 | 1.40 | 1100 | ○ | 15.1 |
| 2 | 0.6 | " | " | " | " | " | " | " | " | " | " | " | 1180 | " | 291 | 2.1 | 1.30 | 1.30 | 900 | ◎ | 15.0 |
| 3 | 0.7 | " | " | " | " | " | " | " | " | " | " | " | 1195 | 510 | 248 | 4.1 | 1.33 | 1.27 | 1000 | ◎ | 16.5 |
| 4 | 0.9 | " | " | " | " | " | " | " | " | " | " | no | 1190 | " | 250 | 5.6 | 1.30 | 1.22 | 900 | ◎ | 15.0 |
| 5 | 1.2 | " | " | " | " | " | " | " | " | " | " | yes | " | " | 254 | 8.9 | 1.28 | 1.15 | 900 | ○ | 15.6 |
| 6 | 0.7 | 0.3 | " | " | " | " | " | " | " | " | " | " | " | 450 | 256 | 9.5 | 1.33 | 1.27 | 1000 | ◎ | 16.1 |
| 7 | " | 0.5 | " | " | " | " | " | " | " | " | " | " | 1170 | " | 275 | 3.3 | 1.34 | 1.28 | 1100 | ◎ | 16.0 |
| 8 | " | 1.2 | " | " | " | " | " | " | " | " | " | " | 1190 | " | 253 | 4.3 | 1.34 | 1.29 | 1100 | ◎ | 16.4 |
| 9 | " | 1.5 | " | " | " | " | " | " | " | " | " | " | " | " | 255 | 8.7 | 1.34 | 1.32 | 1000 | ◎ | 16.1 |
| 10 | " | 1.0 | 0.2 | " | " | " | " | " | " | " | " | " | " | " | 255 | 3.5 | 1.32 | 1.35 | 1000 | ○ | 15.3 |
| 11 | " | " | 0.3 | " | " | " | " | " | " | " | " | " | 1200 | " | 240 | 4.0 | 1.33 | 1.29 | 1200 | ◎ | 16.2 |
| 12 | " | " | 0.7 | " | " | " | " | " | " | " | " | " | 1170 | " | 280 | 4.0 | 1.33 | 1.28 | 1100 | ◎ | 16.8 |
| 13 | " | " | 0.8 | " | " | " | " | " | " | " | " | " | 1190 | " | 252 | 3.3 | 1.32 | 1.34 | 1000 | ○ | 15.9 |
| 14 | " | " | 0.5 | 0.5 | " | " | " | " | " | " | " | no | 1170 | 510 | 253 | 9.7 | 1.41 | 1.29 | 1000 | ○ | 14.5 |
| 15 | " | " | " | 0.8 | " | " | " | " | " | " | " | yes | 1180 | " | 251 | 3.9 | 1.32 | 1.30 | 1000 | ◎ | 16.3 |
| 16 | " | " | " | 1.2 | " | " | " | " | " | " | " | " | 1210 | " | 249 | 4.1 | 1.30 | 1.29 | 1100 | ◎ | 16.2 |
| 17 | " | " | " | 1.5 | " | " | " | " | " | " | " | " | 1220 | " | 253 | 8.6 | 1.31 | 1.36 | 900 | ○ | 15.1 |
| 18 | 0.7 | 1.0 | 0.5 | 1.0 | 0.1 | 1.3 | 1.0 | 0.005 | 0.005 | 0.01 | yes | yes | 1190 | 510 | 253 | 9.8 | 1.32 | 1.29 | 1000 | ◎ | 16.4 |
| 19 | " | " | " | " | 0.3 | " | " | " | " | " | " | " | " | " | 251 | 3.9 | 1.32 | 1.29 | 1100 | ◎ | 16.5 |
| 20 | " | " | " | " | 1.0 | " | " | " | " | " | " | " | " | " | 250 | 4.0 | 1.33 | 1.29 | 1000 | ◎ | 16.9 |
| 21 | " | " | " | " | 1.5 | " | " | " | " | " | " | " | " | " | 256 | 7.8 | 1.33 | 1.28 | 900 | ◎ | 16.1 |
| 22 | " | " | " | " | 0.5 | 0.8 | " | " | " | " | " | " | 1200 | " | 243 | 8.4 | 1.43 | 1.33 | 1000 | ◎ | 14.7 |
| 23 | " | " | " | " | " | 1.0 | 1.0 | " | " | " | " | " | " | " | 242 | 4.6 | 1.35 | 1.27 | 1000 | ◎ | 16.9 |
| 24 | " | " | " | " | " | 1.5 | " | " | " | " | " | " | " | " | 245 | 3.3 | 1.33 | 1.30 | " | ◎ | 16.5 |
| 25 | " | " | " | " | " | 2.5 | " | " | " | " | " | " | 1210 | " | 231 | 9.4 | 1.30 | 1.32 | 900 | ○ | 15.4 |
| 26 | " | " | " | " | " | 1.3 | 0.6 | " | " | " | " | " | 1170 | " | 253 | 2.0 | 1.32 | 1.28 | 1000 | ○ | 14.8 |
| 27 | " | " | " | " | " | " | 0.7 | " | " | " | " | no | 1180 | " | 250 | 6.7 | 1.32 | 1.29 | 1000 | ◎ | 15.7 |
| 28 | " | " | " | " | " | " | 1.4 | " | " | " | " | yes | 1190 | " | 254 | 4.0 | 1.33 | 1.30 | 1100 | ◎ | 16.9 |
| 29 | " | " | " | " | " | " | 2.0 | " | " | " | " | " | 1240 | " | 231 | 8.1 | 1.34 | 1.31 | " | ◎ | 15.2 |
| 30 | " | " | " | " | " | " | 1.0 | 0.001 | " | " | " | " | 1190 | 525 | 251 | 1.4 | 1.35 | 1.22 | " | ◎ | 14.3 |
| 31 | " | " | " | " | " | " | " | " | " | " | " | " | " | 510 | 248 | 1.5 | 1.34 | 1.13 | 1000 | ◎ | 14.2 |
| 32 | " | " | " | " | " | " | " | " | " | " | " | " | " | 450 | 249 | 1.8 | 1.33 | 1.14 | " | ◎ | 14.3 |
| 33 | " | " | " | " | " | " | " | " | " | " | " | " | " | 400 | 252 | 3.5 | 1.35 | 1.19 | " | ○ | 14.6 |
| 34 | " | " | " | " | " | " | " | 0.002 | " | " | " | " | 1170 | 520 | 275 | 1.6 | 1.33 | 1.25 | " | ◎ | 15.5 |
| 35 | 0.7 | 1.0 | 0.5 | 1.0 | 0.5 | 1.3 | 1.0 | 0.002 | 0.005 | 0.01 | yes | yes | 1170 | 510 | 278 | 1.7 | 1.34 | 1.15 | 1000 | ◎ | 15.7 |
| 36 | " | " | " | " | " | " | " | " | " | " | " | " | 1130 | 450 | 326 | 2.0 | 1.32 | 1.16 | 900 | ◎ | 14.8 |
| 37 | " | " | " | " | " | " | " | " | " | " | " | " | 1170 | 400 | 279 | 3.6 | 1.33 | 1.23 | 1000 | ○ | 15.3 |
| 38 | " | " | " | " | " | " | " | 0.003 | " | " | " | no | 1180 | 525 | 264 | 4.6 | 1.33 | 1.28 | 1000 | ○ | 15.0 |
| 39 | " | " | " | " | " | " | " | " | " | " | " | yes | " | 510 | 263 | 2.2 | 1.32 | 1.18 | 1100 | ◎ | 15.9 |
| 40 | " | " | " | " | " | " | " | " | " | " | " | " | " | 450 | 262 | 3.0 | 1.32 | 1.17 | " | ◎ | 16.3 |
| 41 | " | " | " | " | " | " | " | " | " | " | " | " | " | 400 | 263 | 4.9 | 1.33 | 1.25 | 1000 | ○ | 16.2 |
| 42 | " | " | " | " | " | " | " | 0.005 | " | " | " | " | 1190 | 520 | 256 | 2.5 | 1.33 | 1.30 | 1000 | ◎ | 16.6 |
| 43 | " | " | " | " | " | " | " | " | " | " | " | " | " | 510 | 253 | 3.0 | 1.32 | 1.20 | " | ◎ | 16.9 |
| 44 | " | " | " | " | " | " | " | " | " | " | " | " | 1130 | 450 | 320 | 3.9 | 1.33 | 1.29 | 900 | ◎ | 15.4 |
| 45 | " | " | " | " | " | " | " | " | " | " | " | " | 1190 | 400 | 251 | 5.3 | 1.33 | 1.29 | 900 | ○ | 17.0 |
| 46 | " | " | " | " | " | " | " | 0.01 | " | " | " | " | " | 520 | 255 | 3.6 | 1.40 | 1.36 | 1000 | ◎ | 17.0 |

TABLE 1-continued

| Item | Element composition (mole %) | | | | | | | | | | Producing method | | | | Characteristic properties | | | | | | |
|---|---|---|---|---|---|---|---|---|---|---|---|---|---|---|---|---|---|---|---|---|---|
| | $Bi_2O_3$ | $Co_2O_3$ | $MnO_2$ | $Sb_2O_3$ | $Cr_2O_3$ | NiO | $SiO_2$ | $Al_2O_3$ | $B_2O_3$ | $Ag_2O$ | Calcining of Al and ZnO | Mixing in atlighter | Sintering (°C.) | Heat treatment (°C.) | $V_{0.1mA}$ | $\Delta V_{0.1mA}$ | $V_{10A}/V_{0.1mA}$ | $V_{0.1mA}/V_{1\mu A}$ | Switching capability (A) | Life | Lightning capability (KJ) |
| 47 | " | " | " | " | " | " | " | " | " | " | " | " | " | 510 | 254 | 4.0 | " | 1.24 | " | ⊙ | 16.7 |
| 48 | " | " | " | " | " | " | " | " | " | " | " | " | " | 450 | 253 | 4.8 | 1.39 | 1.24 | " | ⊙ | 16.8 |
| 49 | " | " | " | " | " | " | " | " | " | " | " | " | 1170 | 400 | 274 | 7.4 | " | 1.36 | " | ○ | 16.0 |
| 50 | " | " | " | " | " | " | " | 0.02 | " | " | " | " | 1200 | 520 | 250 | 4.4 | 1.44 | 1.39 | " | ○ | 15.3 |
| 51 | " | " | " | " | " | " | " | " | " | " | " | no | " | 510 | 256 | 8.2 | 1.45 | 1.29 | 900 | ○ | 14.6 |
| 52 | 0.7 | 1.0 | 0.5 | 1.0 | 0.5 | 1.3 | 1.0 | 0.02 | 0.005 | 0.01 | yes | yes | 1220 | 450 | 236 | 7.0 | 1.43 | 1.36 | 900 | ○ | 15.1 |
| 53 | " | " | " | " | " | " | " | " | " | " | " | " | 1160 | 400 | 304 | 9.5 | 1.41 | 1.38 | " | ○ | 14.7 |
| 54 | " | " | " | " | " | " | " | 0.005 | 0.0001 | " | " | " | 1180 | 520 | 265 | 2.7 | 1.42 | 1.40 | 1100 | ○ | 14.9 |
| 55 | " | " | " | " | " | " | " | " | 0.001 | " | " | " | " | 510 | 262 | 4.0 | 1.39 | 1.34 | 1200 | ⊙ | 15.8 |
| 56 | " | " | " | " | " | " | " | " | 0.03 | " | " | " | " | 450 | 264 | 4.5 | 1.30 | 1.20 | 1100 | ⊙ | 16.0 |
| 57 | " | " | " | " | " | " | " | " | 0.05 | " | " | " | 1130 | 400 | 330 | 9.3 | 1.26 | 1.14 | 900 | ⊙ | 15.0 |
| 58 | " | " | " | " | " | " | " | " | 0.005 | 0.001 | " | " | 1190 | 525 | 250 | 8.3 | 1.29 | 1.31 | " | ⊙ | 16.3 |
| 59 | " | " | " | " | " | " | " | " | " | 0.002 | " | " | " | 510 | 251 | 5.0 | 1.33 | 1.30 | 1100 | ⊙ | 17.1 |
| 60 | " | " | " | " | " | " | " | " | " | 0.03 | " | " | " | 450 | 249 | 3.2 | 1.35 | 1.33 | 1200 | ⊙ | 16.8 |
| 61 | " | " | " | " | " | " | " | " | " | 0.05 | " | no | " | 400 | 252 | 9.2 | 1.43 | 1.40 | 900 | ○ | 14.5 |
| Comparative Example | | | | | | | | | | | | | | | | | | | | | |
| 1 | 0.3 | 1.0 | 0.5 | 1.0 | 0.5 | 1.3 | 1.0 | 0.005 | 0.005 | 0.01 | yes | yes | 1210 | 510 | 254 | 13.2 | 1.41 | 1.49 | 800 | X | 12.5 |
| 2 | 1.5 | " | " | " | " | " | " | " | " | " | " | " | 1190 | 510 | " | 15.9 | 1.39 | 1.15 | 600 | ○ | 14.0 |
| 3 | 0.7 | 0.1 | " | " | " | " | " | " | " | " | " | " | " | 450 | " | 12.5 | 1.32 | 1.27 | 900 | ⊙ | 15.3 |
| 4 | " | 2.0 | " | " | " | " | " | " | " | " | " | " | " | " | 252 | 14.3 | 1.34 | 1.37 | 1000 | ○ | 15.1 |
| 5 | " | 1.0 | 0.1 | " | " | " | " | " | " | " | " | " | " | " | 249 | 5.1 | 1.32 | 1.41 | " | X | 15.1 |
| 6 | " | " | 1.0 | " | " | " | " | " | " | " | " | " | " | " | 253 | 5.9 | 1.33 | 1.41 | " | X | 14.9 |
| 7 | " | " | 0.5 | 0.2 | " | " | " | " | " | " | " | " | 1170 | 510 | 253 | 11.9 | 1.47 | 1.33 | " | ○ | 13.2 |
| 8 | " | " | " | 2.0 | " | " | " | " | " | " | " | " | 1230 | " | 254 | 15.3 | 1.29 | 1.39 | 600 | X | 12.1 |
| 9 | " | " | " | 1.0 | 0 | " | " | " | " | " | " | " | 1190 | " | 251 | 16.2 | 1.32 | 1.27 | 900 | ○ | 15.3 |
| 10 | " | " | " | " | 2.0 | " | " | " | " | " | " | " | " | " | 261 | 15.8 | 1.33 | 1.31 | 800 | ○ | 15.0 |
| 11 | " | " | " | " | 0.5 | 0.5 | " | " | " | " | " | " | 1200 | " | 243 | 15.6 | 1.46 | 1.33 | 900 | ○ | 13.0 |
| 12 | " | " | " | " | " | 3.0 | " | " | " | " | " | " | 1210 | " | 244 | 16.7 | 1.30 | 1.32 | 500 | X | 14.3 |
| 13 | " | " | " | " | " | 1.3 | 0.3 | " | " | " | " | " | 1170 | " | 255 | 2.5 | 1.33 | 1.28 | 900 | X | 11.9 |
| 14 | " | " | " | " | " | " | 2.5 | " | " | " | " | " | 1210 | " | 256 | 13.2 | 1.34 | 1.30 | 900 | ⊙ | 12.7 |
| 15 | " | " | " | " | " | " | 1.0 | 0.04 | " | " | " | " | 1200 | 520 | 251 | 10.1 | 1.50 | 1.50 | 700 | X | 13.8 |
| 16 | 0.7 | 1.0 | 0.5 | 1.0 | 0.5 | 1.3 | 1.0 | 0.04 | 0.005 | 0.01 | yes | yes | 1200 | 510 | 250 | 10.5 | 1.49 | 1.41 | 600 | X | 13.5 |
| 17 | " | " | " | " | " | " | " | " | " | " | " | " | " | 450 | 253 | 13.6 | 1.50 | 1.43 | 700 | X | 13.2 |
| 18 | " | " | " | " | " | " | " | " | " | " | " | " | " | 400 | 251 | 23.0 | 1.49 | 1.55 | 600 | X | 13.6 |
| 19 | " | " | " | " | " | " | " | 0.002 | " | " | " | " | 1190 | 540 | 253 | 2.0 | 1.34 | 1.42 | 800 | X | 15.4 |
| 20 | " | " | " | " | " | " | " | 0.005 | 0 | " | " | " | 1200 | 510 | 264 | 4.1 | 1.20 | 1.45 | " | X | 15.7 |
| 21 | " | " | " | " | " | " | " | " | 0.1 | " | " | " | " | " | 263 | 15.2 | 1.24 | 1.33 | " | ○ | 15.9 |
| 22 | " | " | " | " | " | " | " | " | 0.005 | 0 | " | " | 1190 | " | 253 | 17.7 | 1.23 | 1.32 | " | ○ | 16.0 |
| 23 | " | " | " | " | " | " | " | " | " | 0.1 | " | " | " | " | 252 | 10.4 | 1.48 | 1.52 | 1000 | X | 12.1 |
| 24 | " | " | " | " | " | " | " | " | " | 0.01 | no | no | " | " | 253 | 12.8 | 1.32 | 1.41 | 700 | X | 13.6 |
| 25 | " | " | " | " | " | " | " | " | " | " | " | yes | " | " | 254 | 11.3 | 1.32 | 1.38 | 800 | ○ | 14.9 |
| 26 | " | " | " | " | " | " | " | " | " | " | yes | " | 1250 | " | 210 | 10.6 | 1.35 | 1.30 | 1000 | ○ | 15.5 |
| 27 | " | " | " | " | " | " | " | " | " | " | " | " | 1120 | " | 350 | 10.8 | 1.35 | 1.30 | 600 | X | 12.0 |
| 28 | " | " | " | " | " | " | " | " | " | " | " | " | 1190 | 535 | 253 | 2.0 | 1.33 | 1.45 | 900 | X | 15.8 |
| 29 | " | " | " | " | " | " | " | " | " | " | " | " | " | 380 | 254 | 13.0 | 1.34 | 1.46 | " | X | 14.0 |

Notes
1: Switching capability means switching current impulse withstanding capability.
2: Lightning capability means lightning current impulse withstanding capability.

EXAMPLES 62–123 AND COMPARATIVE EXAMPLES 30–56

Green bodies of compositions as shown in the later-described Table 2 are treated in the production conditions as shown in Table 2 to produce voltage non-linear resistor bodies of a size of $\phi$47 mm $\times$ h22.5 mm of Examples 62–123 and Comparative Examples 30–56. Characteristic properties of these resistors are shown in Table 2.

Raw materials, calcining of Al and ZnO, mixing of ZnO and the other metal oxides, sintering, final heat treatment and evaluation of electric properties are used or effected in the same manner as described in Examples 1–61 and Comparative Examples 1–29.

The above values are not influenced by a size of the voltage non-linear resistor bodies. For example, similar results were obtained when the resistor bodies have a disc shape of a diameter of 70 mm.

TABLE 2

| Item | Element composition (mole %) | | | | | | | | | | Producing method | | | | Characteristic properties | | | | | | |
|---|---|---|---|---|---|---|---|---|---|---|---|---|---|---|---|---|---|---|---|---|---|
| | $Bi_2O_3$ | $Co_2O_3$ | $MnO_2$ | $Sb_2O_3$ | NiO | $SiO_2$ | $Al_2O_3$ | $B_2O_3$ | $Ag_2O$ | $Cr_2O_3$ | Calcining of Al and ZnO | Mixing in atlighter | Sintering (°C.) | Heat treatment (°C.) | $V_{0.1mA}$ | $\Delta V_{0.1mA}$ | $V_{10A}/V_{0.1mA}$ | $V_{0.1mA}/V_{1\mu A}$ | Switching capability (A) | Life | Lightning capability (KJ) |
| Example | | | | | | | | | | | | | | | | | | | | | |
| 62 | 0.3 | 1.0 | 0.5 | 1.0 | 1.3 | 8.0 | 0.005 | 0.005 | 0.01 | 0.1 | yes | yes | 1200 | 550 | 381 | 6.2 | 1.43 | 1.38 | 12.0 | ○ | 12.4 |
| 63 | 0.5 | " | " | " | " | " | " | " | " | " | " | " | 1150 | " | 432 | 4.4 | 1.35 | 1.29 | 14.9 | ◎ | 14.7 |
| 64 | 0.7 | " | " | " | " | " | " | " | " | " | " | " | 1140 | " | 422 | 4.3 | 1.28 | 1.20 | 13.1 | ◎ | 14.9 |
| 65 | 0.9 | " | " | " | " | " | " | " | " | " | " | " | 1070 | " | 538 | 7.3 | 1.25 | 1.36 | 11.0 | ○ | 12.1 |
| 66 | 1.1 | " | " | " | " | " | " | " | " | " | " | no | 1130 | " | 420 | 8.9 | 1.20 | 1.22 | 11.3 | ○ | 12.0 |
| 67 | 0.7 | 0.3 | " | " | " | " | " | " | " | 0 | " | yes | 1190 | 450 | 351 | 8.7 | 1.30 | 1.22 | 12.0 | ◎ | 12.8 |
| 68 | " | 0.5 | " | " | " | " | " | " | " | " | " | " | 1100 | " | 482 | 4.2 | 1.29 | 1.21 | 13.0 | ◎ | 15.2 |
| 69 | " | 1.2 | " | " | " | " | " | " | " | " | " | " | 1140 | " | 425 | 4.0 | 1.30 | 1.29 | 12.9 | ◎ | 15.0 |
| 70 | " | 1.5 | " | " | " | " | " | " | " | " | " | " | 1150 | " | 405 | 9.1 | 1.31 | 1.38 | 12.4 | ○ | 14.7 |
| 71 | " | 1.0 | 0.2 | " | " | " | " | " | " | " | " | " | 1100 | 500 | 480 | 5.6 | 1.30 | 1.36 | 12.9 | ○ | 14.6 |
| 72 | " | " | 0.3 | " | " | " | " | " | " | " | " | " | 1150 | " | 400 | 4.0 | 1.27 | 1.20 | 13.3 | ◎ | 15.0 |
| 73 | " | " | 0.7 | " | " | " | " | " | " | " | " | " | 1140 | " | 421 | 4.1 | 1.28 | 1.21 | 13.0 | ◎ | 14.7 |
| 74 | " | " | 0.8 | " | " | " | " | " | " | " | " | " | " | " | 426 | 6.2 | 1.30 | 1.34 | 13.5 | ○ | 13.9 |
| 75 | " | " | 0.5 | 0.5 | " | " | " | " | " | 0.1 | " | " | 1120 | 480 | 425 | 7.6 | 1.40 | 1.24 | 13.0 | ◎ | 12.6 |
| 76 | " | " | " | 0.8 | " | " | " | " | " | " | " | " | 1130 | " | 421 | 3.8 | 1.30 | 1.22 | 13.3 | ◎ | 14.5 |
| 77 | " | " | " | 1.2 | " | " | " | " | " | " | " | no | 1150 | " | 420 | 6.7 | 1.27 | 1.31 | 12.0 | ○ | 13.0 |
| 78 | " | " | " | 1.5 | " | " | " | " | " | " | " | yes | 1160 | " | 423 | 9.8 | 1.28 | 1.36 | 12.6 | ○ | 12.9 |
| 79 | 0.7 | 1.0 | 0.5 | 1.0 | 0.8 | 8.0 | 0.005 | 0.005 | 0.01 | 0.1 | yes | yes | 1140 | 500 | 416 | 9.5 | 1.37 | 1.31 | 13.0 | ○ | 13.5 |
| 80 | " | " | " | " | 1.0 | " | " | " | " | " | " | " | " | " | 418 | 4.8 | 1.33 | 1.23 | 14.0 | ◎ | 14.6 |
| 81 | " | " | " | " | 1.5 | " | " | " | " | " | " | " | " | " | 420 | 4.0 | 1.30 | 1.22 | 13.3 | ◎ | 15.0 |
| 82 | " | " | " | " | 2.5 | " | " | " | " | " | " | " | 1150 | " | 425 | 8.7 | 1.32 | 1.25 | 11.0 | ○ | 13.9 |
| 83 | " | " | " | " | 1.3 | 5.0 | " | " | " | " | " | " | " | 480 | 342 | 10.0 | 1.30 | 1.30 | 13.0 | ○ | 14.2 |
| 84 | " | " | " | " | " | 6.0 | " | " | " | " | " | " | 1120 | " | 406 | 4.9 | 1.29 | 1.21 | 13.2 | ◎ | 15.0 |
| 85 | " | " | " | " | " | 9.0 | " | " | " | " | " | no | 1100 | " | 491 | 6.8 | 1.30 | 1.34 | 13.1 | ○ | 13.9 |
| 86 | " | " | " | " | " | 10.0 | " | " | " | " | " | yes | 1070 | " | 550 | 8.8 | 1.31 | 1.40 | 12.0 | ○ | 12.4 |
| 87 | " | " | " | " | " | 8.0 | 0.001 | " | " | 0.5 | " | " | 1140 | 580 | 423 | 1.5 | 1.23 | 1.18 | 11.9 | ◎ | 12.1 |
| 88 | " | " | " | " | " | " | " | " | " | " | " | " | 1140 | 550 | 425 | 1.8 | 1.23 | 1.13 | 12.0 | ◎ | 12.5 |
| 89 | " | " | " | " | " | " | " | " | " | " | " | " | 1070 | 450 | 531 | 6.3 | 1.24 | 1.39 | 12.0 | ○ | 12.0 |
| 90 | " | " | " | " | " | " | " | " | " | " | " | " | 1140 | 400 | 420 | 4.0 | 1.22 | 1.19 | 12.1 | ○ | 12.0 |
| 91 | " | " | " | " | " | " | 0.002 | " | " | " | " | " | 1160 | 580 | 455 | 1.6 | 1.25 | 1.23 | 13.2 | ◎ | 14.4 |
| 92 | " | " | " | " | " | " | " | " | " | " | " | " | " | 550 | 452 | 2.0 | 1.26 | 1.15 | 13.0 | ◎ | 14.1 |
| 93 | " | " | " | " | " | " | " | " | " | " | " | " | " | 450 | 453 | 2.6 | 1.25 | 1.16 | 13.4 | ◎ | 14.0 |
| 94 | " | " | " | " | " | " | " | " | " | " | " | " | " | 400 | 454 | 4.6 | 1.27 | 1.22 | 12.9 | ○ | 13.3 |
| 95 | " | " | " | " | " | " | 0.003 | " | " | " | " | " | 1170 | 600 | 470 | 2.7 | 1.27 | 1.29 | 13.3 | ◎ | 15.2 |
| 96 | 0.7 | 1.0 | 0.5 | 1.0 | 1.3 | 8.0 | 0.003 | 0.005 | 0.01 | 0.5 | yes | yes | 1150 | 550 | 498 | 2.8 | 1.28 | 1.17 | 13.6 | ◎ | 15.4 |
| 97 | " | " | " | " | " | " | " | " | " | " | " | " | 1170 | 450 | 471 | 3.0 | 1.29 | 1.18 | 13.7 | ◎ | 15.6 |
| 98 | " | " | " | " | " | " | " | " | " | " | " | " | " | 400 | 469 | 4.8 | 1.26 | 1.26 | 13.0 | ○ | 15.1 |
| 99 | " | " | " | " | " | " | 0.005 | " | " | " | " | " | 1140 | 600 | 430 | 2.7 | 1.29 | 1.33 | 13.0 | ◎ | 15.0 |
| 100 | " | " | " | " | " | " | " | " | " | " | " | " | 1100 | 550 | 366 | 8.9 | 1.28 | 1.33 | 12.2 | ○ | 13.8 |
| 101 | " | " | " | " | " | " | " | " | " | " | " | " | 1150 | 450 | 406 | 3.9 | 1.30 | 1.19 | 13.3 | ◎ | 15.7 |
| 102 | " | " | " | " | " | " | " | " | " | " | " | " | 1140 | 400 | 425 | 6.5 | 1.28 | 1.30 | 13.0 | ○ | 14.8 |
| 103 | " | " | " | " | " | " | 0.01 | " | " | " | " | " | 1080 | 600 | 519 | 5.1 | 1.38 | 1.38 | 12.6 | ○ | 13.5 |
| 104 | " | " | " | " | " | " | " | " | " | " | " | no | 1075 | 550 | 528 | 8.8 | 1.40 | 1.39 | 12.5 | ○ | 13.0 |
| 105 | " | " | " | " | " | " | " | " | " | " | " | yes | 1140 | 450 | 430 | 4.8 | 1.39 | 1.25 | 13.8 | ◎ | 15.9 |
| 106 | " | " | " | " | " | " | " | " | " | " | " | " | " | 400 | 431 | 7.9 | 1.37 | 1.33 | 12.9 | ○ | 14.8 |
| 107 | " | " | " | " | " | " | 0.02 | " | " | " | " | " | 1150 | 580 | 426 | 4.1 | 1.43 | 1.39 | 13.0 | ○ | 13.6 |

TABLE 2-continued

| Item | Element composition (mole %) $Bi_2O_3$ | $Co_2O_3$ | $MnO_2$ | $Sb_2O_3$ | NiO | $SiO_2$ | $Al_2O_3$ | $B_2O_3$ | $Ag_2O$ | $Cr_2O_3$ | Producing method: Calcining of Al and ZnO | Mixing in atlighter | Sintering (°C.) | Heat treatment (°C.) | Characteristic properties: $V_{0.1mA}$ | $\Delta V_{0.1mA}$ | $V_{10A}/V_{0.1mA}$ | $V_{0.1mA}/V_{1\mu A}$ | Switching capability (A) | Life | Lightning capability (KJ) |
|---|---|---|---|---|---|---|---|---|---|---|---|---|---|---|---|---|---|---|---|---|---|
| 108 | " | " | " | " | " | " | " | " | " | " | " | " | " | 550 | 428 | 4.9 | 1.45 | 1.30 | 12.9 | ◎ | 13.8 |
| 109 | " | " | " | " | " | " | " | " | " | " | " | no | " | 450 | 426 | 9.0 | 1.44 | 1.36 | 12.0 | ○ | 13.1 |
| 110 | " | " | " | " | " | " | " | " | " | " | " | yes | " | 400 | 430 | 9.5 | 1.43 | 1.40 | 12.3 | ○ | 13.0 |
| 111 | " | " | " | " | " | " | 0.005 | 0.0001 | " | 1.0 | " | " | 1140 | 500 | 425 | 1.5 | 1.41 | 1.37 | 13.7 | ○ | 13.9 |
| 112 | " | " | " | " | " | " | " | 0.001 | " | " | " | " | 1100 | 500 | 482 | 2.9 | 1.33 | 1.30 | 13.9 | ◎ | 14.6 |
| 113 | 0.7 | 1.0 | 0.5 | 1.0 | 1.3 | 8.0 | 0.005 | 0.03 | 0.01 | 1.0 | yes | yes | 1140 | 500 | 426 | 4.9 | 1.28 | 1.25 | 13.0 | ◎ | 14.4 |
| 114 | " | " | " | " | " | " | " | 0.05 | " | " | " | " | " | " | 427 | 9.8 | 1.25 | 1.22 | 12.5 | ◎ | 14.1 |
| 115 | " | " | " | " | " | " | " | 0.005 | 0.001 | " | " | " | 1170 | " | 376 | 8.9 | 1.22 | 1.33 | 12.0 | ○ | 14.0 |
| 116 | " | " | " | " | " | " | " | " | 0.002 | " | " | " | 1140 | " | 426 | 4.9 | 1.25 | 1.29 | 12.7 | ◎ | 14.6 |
| 117 | " | " | " | " | " | " | " | " | 0.03 | " | " | " | 1120 | " | 456 | 3.0 | 1.30 | 1.30 | 13.1 | ◎ | 14.0 |
| 118 | " | " | " | " | " | " | " | " | 0.05 | " | " | " | 1140 | " | 429 | 8.2 | 1.40 | 1.36 | 13.8 | ○ | 12.8 |
| 119 | " | " | " | " | " | " | " | " | 0.01 | 0 | " | " | " | 550 | 427 | 5.2 | 1.28 | 1.21 | 12.9 | ◎ | 14.5 |
| 120 | " | " | " | " | " | " | " | " | " | 0.3 | " | " | " | " | 426 | 2.1 | 1.30 | 1.20 | 13.0 | ◎ | 15.2 |
| 121 | " | " | " | " | " | " | " | " | " | 0.7 | " | " | 1120 | " | 455 | 0.9 | 1.29 | 1.21 | 13.0 | ◎ | 15.0 |
| 122 | " | " | " | " | " | " | " | " | " | 1.0 | " | " | " | " | 457 | 2.9 | 1.29 | 1.22 | 13.2 | ◎ | 14.3 |
| 123 | " | " | " | " | " | " | " | " | " | 1.5 | " | no | " | " | 458 | 8.4 | 1.30 | 1.33 | 11.8 | ○ | 13.0 |
| Comparative Example | | | | | | | | | | | | | | | | | | | | | |
| 30 | 0.1 | 1.0 | 0.5 | 1.0 | 1.3 | 8.0 | 0.005 | 0.005 | 0.01 | 0.1 | yes | yes | 1160 | 550 | 441 | 10.2 | 1.51 | 1.44 | 10.0 | X | 9.3 |
| 31 | 1.5 | " | " | " | " | " | " | " | " | " | " | " | 1120 | " | 436 | 15.4 | 1.30 | 1.24 | 10.3 | ○ | 10.6 |
| 32 | 0.7 | 0.1 | " | " | " | " | " | " | " | 0 | " | " | 1140 | 450 | 426 | 12.3 | 1.32 | 1.25 | 12.1 | ◎ | 14.9 |
| 33 | " | 2.0 | " | " | " | " | " | " | " | " | " | " | " | " | 427 | 15.4 | 1.31 | 1.40 | 12.3 | ○ | 14.5 |
| 34 | " | 1.0 | 0.1 | " | " | " | " | " | " | " | " | " | 1150 | 500 | 402 | 6.7 | 1.29 | 1.42 | 12.9 | X | 14.0 |
| 35 | " | " | 1.0 | " | " | " | " | " | " | " | " | " | " | " | 404 | 7.2 | 1.31 | 1.43 | 13.3 | X | 13.8 |
| 36 | " | " | 0.5 | 0.2 | " | " | " | " | " | 0.1 | " | " | 1110 | 480 | 419 | 12.0 | 1.41 | 1.33 | 12.3 | ○ | 11.8 |
| 37 | " | " | " | 2.0 | " | " | " | " | " | " | " | " | 1170 | " | 428 | 20.1 | 1.29 | 1.41 | 8.2 | X | 10.0 |
| 38 | " | " | " | 1.0 | 0.5 | " | " | " | " | " | " | " | 1140 | 500 | 411 | 18.2 | 1.40 | 1.32 | 11.6 | ○ | 13.2 |
| 39 | " | " | " | " | 3.0 | " | " | " | " | " | " | " | 1150 | " | 429 | 13.8 | 1.33 | 1.29 | 9.4 | X | 13.0 |
| 40 | " | " | " | " | 1.3 | 4.0 | " | " | " | " | " | " | 1060 | 480 | 439 | 13.6 | 1.30 | 1.32 | 12.9 | ○ | 12.0 |
| 41 | " | " | " | " | " | 11.0 | " | " | " | " | " | " | 1190 | " | 421 | 12.9 | 1.31 | 1.50 | 10.3 | X | 10.9 |
| 42 | " | " | " | " | " | 8.0 | 0.04 | " | " | 0.5 | " | " | 1150 | 600 | 431 | 8.0 | 1.50 | 1.59 | 11.5 | X | 12.5 |
| 43 | " | " | " | " | " | " | " | " | " | " | " | " | " | 550 | 430 | 9.2 | 1.49 | 1.44 | 11.6 | X | 13.1 |
| 44 | 0.7 | 1.0 | 0.5 | 1.0 | 1.3 | 8.0 | 0.04 | 0.005 | 0.01 | 0.5 | yes | yes | 1150 | 450 | 432 | 12.0 | 1.48 | 1.43 | 12.0 | X | 13.0 |
| 45 | " | " | " | " | " | " | " | " | " | " | " | " | " | 400 | 431 | 24.1 | 1.50 | 1.61 | 10.4 | X | 12.7 |
| 46 | " | " | " | " | " | " | 0.005 | 0 | " | 1.0 | " | " | 1140 | 500 | 422 | 4.1 | 1.30 | 1.43 | 13.0 | X | 14.0 |
| 47 | " | " | " | " | " | " | " | 0.1 | " | " | " | " | " | " | 428 | 16.3 | 1.27 | 1.26 | 12.0 | ○ | 13.9 |
| 48 | " | " | " | " | " | " | " | 0.005 | 0 | " | " | " | " | " | 422 | 15.7 | 1.24 | 1.39 | 12.0 | X | 13.5 |
| 49 | " | " | " | " | " | " | " | " | 0.1 | " | " | " | " | " | 431 | 16.1 | 1.46 | 1.43 | 12.6 | X | 11.1 |
| 50 | " | " | " | " | " | " | " | " | 0.01 | 0.1 | no | no | " | 550 | 425 | 13.4 | 1.29 | 1.44 | 10.6 | X | 10.9 |
| 51 | " | " | " | " | " | " | " | " | " | " | " | yes | " | " | 423 | 12.1 | 1.28 | 1.39 | 11.5 | X | 11.6 |
| 52 | " | " | " | " | " | " | " | " | " | " | yes | " | 1230 | " | 300 | 7.9 | 1.30 | 1.25 | 10.9 | ○ | 11.5 |
| 53 | " | " | " | " | " | " | " | " | " | " | " | " | 1000 | " | 600 | 19.8 | 1.36 | 1.38 | 8.8 | X | 8.1 |
| 54 | " | " | " | " | " | " | " | " | " | 0.5 | " | " | 1140 | 650 | 430 | 2.2 | 1.29 | 1.45 | 12.0 | X | 14.1 |
| 55 | " | " | " | " | " | " | 0.002 | " | " | " | " | " | 1160 | 670 | 456 | 1.5 | 1.26 | 1.42 | 12.3 | X | 13.0 |
| 56 | " | " | " | " | " | " | 0.005 | " | " | " | " | " | 1140 | 380 | 426 | 12.7 | 1.30 | 1.46 | 12.1 | X | 13.2 |

Notes
1: Switching capability means switching current impulse withstanding capability.
2: Lightning capability means lightning current impulse withstanding capability.

In the present invention, a high discharge voltage $V_{0.1mA}$ of $V_{0.1mA} \geqq 230_{V/mm}$ and a superior voltage-current characteristic property as shown in FIG. 1 can be obtained by using the above-described composition, calcining the mixture of zinc oxide and aluminum, forming the green body of the element composition, sintering the formed green body at the above-mentioned temperature, and heat treating the sintered body at the above-mentioned temperature.

The voltage non-linear resistor of the present invention has the high discharge voltage $V_{0.1mA}$ and the low deterioration rate of the discharge voltage after applying a lightning current impulse, so that a lightning arrestor using the present voltage non-linear resistor can be extensively shortened in the longitudinal direction thereof. If an atlighter is used in mixing zinc oxide solid soluted with aluminum and the other metal oxide, a further decrease of the aforementioned deterioration rate of the discharge voltage $V_{0.1mA}$ and a further decrease of the length of the lightning arrestor in the longitudinal direction thereof can be realized.

The present resistor can also obtain the good switching current impulse withstanding capability as well as the good lightning current impulse withstanding capability, so that decrease of the length of the lightning arrestor accommodating the resistor in radial direction thereof can also be achieved.

Also, the present resistor has an improved life under electric stress and a good discharge voltage at large current area, so that it is suited well mainly to gapless lightning arrestors, particularly suspension type lightning arrestors, and those lightning arrestors requiring a voltage non-linear resistor having a high discharge voltage $V_{0.1mA}$.

Although the present invention has been explained with reference to specific values and embodiments, it will of course be apparent to those skilled in the art that the present invention is not limited thereto and many variation and modifications are possible without departing from the broad aspect and scope of the present invention as defined in the appended claims.

What is claimed is:

1. A voltage non-linear resistor containing zinc oxide as a main component, and subsidiary components of (a) 0.5–1.2 mole % of bismuth oxide calculated as $Bi_2O_3$, (b) 0.3–1.5 mole % of cobalt oxide calculated as $Co_2O_3$, (c) 0.2–0.8 mole of manganese oxide calculated as $MnO_2$, (d) 0.5–1.5 mole % of antimony oxide calculated as $Sb_2O_3$, (e) 0.1–1.5 mole % of chromium oxide calculated as $Cr_2O_3$, (f) 0.6–2.0 mole % of amorphous silicon oxide calculated as $SiO_2$, (g) 0.8–2.5 mole % of nickel oxide calculated as NiO, (h) not more than 0.02 mole % of aluminum oxide calculated as $Al_2O_3$, (i) 0.0001–0.05 mole % of boron oxide calculated as $B_2O_3$, and p1 (j) 0.001–0.05 mole % of silver oxide calculated as $Ag_2O$, and the resistor having (k) a discharge voltage $V_{0.1mA}$ of 230–330 V/mm at a current density of 0.1 mA/cm$^2$ calculated per unit thickness of the sintered resistor, (l) a discharge voltage ratio $V_{10A}/V_{0.1mA}$ of 1.2–1.45 at current densities of 10 A/cm$^2$ and 0.1 mA/cm$^2$, (m) a deterioration rate of discharge voltage of not more than 10% at a current density of 0.1 mA/cm$^2$ before and after applying twice a lightning current impulse of a current density of 5 kA/cm$^2$ (1/10 μs wave form), and (n) a discharge voltage ratio $V_{0.1mA}/V_{1\mu A}$ of not more than 1.4 at current densities of 0.1 mA/cm$^2$ and 1 μA/cm$^2$.

2. A method of producing a voltage non-linear resistor, comprising, i) forming a green body of the voltage non-linear resistor body containing zinc oxide as a main component, and subsidiary components of (a) 0.5–1.2 mole % of bismuth oxide calculated as $Bi_2O_3$, (b) 0.3–1.5 mole % of cobalt oxide calculated as $Co_2O_3$, (c) 0.2–0.8 mole % of manganese oxide calculated as $MnO_2$, (d) 0.5–1.5 mole % of antimony oxide calculated as $Sb_2O_3$, (e) 0.1–1.5 mole % of chromium oxide calculated as $Cr_2O_3$, (f) 0.6–2.0 mole % of silicon oxide calculated as $SiO_2$, (g) 0.8–2.5 mole % of nickel oxide calculated as NiO, (h) not more than 0.02 mole % of aluminum oxide calculated as $Al_2O_3$, (i) 0.0001–0.05 mole % of boron oxide calculated as $B_2O_3$, and (j) 0.001–0.05 mole % of silver oxide calculated as $AgO_2$, ii) the green body being formed by mixing the main component zinc oxide with a solution containing aluminum corresponding to the amount of (g) aluminum oxide, spray drying the mixture, calcining the spray dried mixture, mixing the calcined mixture with the other metal oxides (a)–(g) and (i)–(j), granulating and forming the mixture, iii) sintering the green body at 1,130°–1,240° C., and iv) heat treating the sintered body at 400°–530° C.

3. A voltage non-linear resistor containing zinc oxide as a main component, and subsidiary components of (a) 0.3–1.1 mole % of bismuth oxide calculated as $Bi_2O_3$, (b) 0.3–1.5 mole % of cobalt oxide calculated as $Co_2O_3$, (c) 0.2–0.8 mole % of manganese oxide calculated as $MnO_2$, (d) 0.5–1.5 mole % of antimony oxide calculated as $Sb_2O_3$, (e) 5.0–10.0 mole % of silicon oxide calculated as $SiO_2$, (f) 0.8–2.5 mole % of nickel oxide calculated as NiO, (g) not more than 0.02 mole % of aluminum oxide calculated as A1203, (h) 0.0001–0.05 mole % of boron oxide calculated as $B_2O_3$, and (i) 0.001–0.05 mole % of silver oxide calculated as $Ag_2O$, and the resistor having (j) a discharge voltage $V_{0.1mA}$ of 340–550 V/mm at a current density of 0.1 mA/cm$^2$ calculated per unit thickness of the sintered resistor, (k) a discharge voltage ratio $V_{0.1mA}/V_{1\mu A}$ of not more than 1.4 at current densities of 0.1 mA/cm$^2$ and 1 μA/cm$^2$, (l) a deterioration rate of discharge voltage of not more than 10% at a current density of 0.1 mA/cm$^2$ before and after applying twice a lightning current impulse of a current density of 2.5 kA/cm$^2$ (4/10 μs wave form), and (m) a discharge voltage ratio $V_{10A}/V_{0.1mA}$ of 1.20–1.45 at current densities of 10 A/cm$^2$ and 0.1 mA/cm$^2$.

4. A method of producing a voltage non-linear resistor, comprising, i) forming a green body of the voltage non-linear resistor body containing zinc oxide as a main component, and subsidiary components of (a) 0.3–1.1 mole % of bismuth oxide calculated as $Bi_2O_3$, (b) 0.3–1 5 mole % of cobalt oxide calculated as $Co_2O_3$, (c) 0.2–0.8 mole % of manganese oxide calculated as $MnO_2$, (d) 0.5–1.5 mole % of antimony oxide calculated as $Sb_2O_3$, (e) 5.0–10.0 mole % of silicon oxide calculated as $SiO_2$, (f) 0.8–2.5 mole % of nickel oxide calculated as NiO, (g) not more than 0.02 mole % of aluminum oxide calculated as $Al_2O_3$, (h) 0.0001–0.05 mole % of boron oxide calculated as $B_2O_3$, and (i) 0.001–0.05 mole % of silver oxide calculated as $Ag_2O$, ii) the green body being formed by mixing the main component zinc oxide with a solution containing aluminum corresponding to the amount of (g) aluminum oxide, spray drying the mixture, calcining the spray dried mixture, mixing the calcined mixture with the other metal oxides (a)–(f) and (h)–(i), granulating and forming the mixture, iii) sintering the green body at 1,070°–1,200° C., and iv) heat treating the sintered body at 400°–600° C.

* * * * *